US006732689B2

(12) United States Patent
Wada et al.

(10) Patent No.: US 6,732,689 B2
(45) Date of Patent: May 11, 2004

(54) VALVE TIMING CONTROL APPARATUS FOR INTERNAL COMBUSTION ENGINE

(75) Inventors: Koji Wada, Tokyo (JP); Tatsuhiko Takahashi, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/281,310

(22) Filed: Oct. 28, 2002

(65) Prior Publication Data

US 2003/0200943 A1 Oct. 30, 2003

(30) Foreign Application Priority Data

Apr. 26, 2002 (JP) ..... 2002-125116

(51) Int. Cl.[7] ..... F01L 1/34

(52) U.S. Cl. ..... 123/90.17; 123/90.15; 74/568 R

(58) Field of Search ..... 123/90.12, 90.15, 123/90.16, 90.17, 406.23; 74/568 R; 464/1, 2, 160; 92/121, 122

(56) References Cited

U.S. PATENT DOCUMENTS 5,769,044 A * 6/1998 Moriya ..... 123/90.17
6,109,225 A * 8/2000 Ogita et al. ..... 123/90.15
6,182,636 B1 * 2/2001 Russell et al. ..... 123/399
6,230,675 B1 * 5/2001 Kobayashi et al. ..... 123/90.15

FOREIGN PATENT DOCUMENTS

JP 2001-363252 11/2001

* cited by examiner

*Primary Examiner*—Thomas Denion
*Assistant Examiner*—Jaime Corrigan
(74) *Attorney, Agent, or Firm*—Sughrue Mion, PLLC

(57) ABSTRACT

A valve timing control apparatus for an engine. Presence/absence of a torque demand (xtq) is estimated upon starting of a lock pin release control to thereby alter a change rate (β) of a target phase angle in dependence on presence/absence of the torque demand (xtq). Unless torque demand is issued, the change rate is set to a small value (β2) for suppressing the change of the target phase angle (θt) after detection of release of the lock pin in order to avoid a shock unexpected by a driver. When the torque demand is issued, the change rate is set to a large value (β1) for allowing the target phase angle to approach speedily to a base target phase angle (θmap) for thereby minimizing a delay in response involved in the phase angle detection through the lock pin release control.

6 Claims, 27 Drawing Sheets

FIG. 4

| | | Ne [rpm] | | | | | |
|---|---|---|---|---|---|---|---|
| | | 500 | 1000 | | ··· | | 7000 |
| Ce | 0.1 | 0 | 0 | | | | 0 |
| | 0.2 | 0 | 5 | | ··· | | 5 |
| | | | | | | | |
| | ··· | ··· | ··· | | ··· | | ··· |
| | | | | | | | |
| | 1.0 | 0 | 30 | | ··· | | 0 |

[deg. CA]

FIG. 14

| Δtvo[%/msec] | 0 | 0.1 | 0.2 | | ··· | | 1.0 |
|---|---|---|---|---|---|---|---|
| $\beta$ | 0.005 | 0.01 | 0.02 | | ··· | | 0.1 |

FIG. 19

| ΔCe[%/msec] | 0 | 0.1 | 0.2 | | ··· | | 1.0 |
|---|---|---|---|---|---|---|---|
| $\beta$ | 0.005 | 0.01 | 0.02 | | ··· | | 0.1 |

VALVE TIMING CONTROL APPARATUS FOR INTERNAL COMBUSTION ENGINE

BACKGROUND OF THE INVENTION

1. Field of the Invention

The present invention generally relates to a valve timing control apparatus for controlling or regulating a valve open/close timing (hereinafter referred to simply as the valve timing) at which an intake valve and/or an exhaust valve of an internal combustion engine is opened and/or closed in dependence on operation state of the engine.

2. Description of Related Art

For having better understanding of the concept underlying the present invention, related techniques known heretofore will first be described in some detail by reference to FIGS. 22 to 26 of the accompanying drawings which shows a conventional valve control apparatus for an internal combustion engine (hereinafter also referred to simply as the engine).

In the figures mentioned above, FIG. 22 is a diametrical sectional view showing an internal structure of a vane-type valve timing regulating apparatus (which may also be referred to as the cam phase actuator), FIG. 23 is a vertical sectional view of the same taken along a line A—A in FIG. 1 and shows a structure in an axial direction, FIG. 24 is a partial perspective view showing a lock/unlock mechanism (lock pin retaining/releasing mechanism) and peripheral structure thereof in the cam phase actuator, and FIGS. 25 and 26 are vertical sectional views showing in detail a structure of the lock/unlock mechanism including a lock pin which constitutes a major part thereof and a peripheral structure provided in association therewith in different operation states, respectively.

Referring to FIGS. 22 to 26, the valve timing regulating actuator includes a first rotor assembly 1 (also referred to as the first rotor) which is constituted by a sprocket 2, a case 3 having a plurality of shoes 3*a*, a cover 4, and clamping members 5 for securing together the sprocket 2, the case 3 and the cover 4, in an integral structure. The first rotor assembly 1 mentioned above constitutes a part of an external rotatable member such as a crank shaft of the engine. (See FIGS. 22 and 23).

Disposed rotatably within the case 3 is a rotor (second rotor) 6 which constitutes an integral part of an internal rotatable shaft of the actuator and which includes a plurality of vanes 6*a* each of which is adapted to slideably move on and along the inner peripheral wall of the case 3. (See FIG. 23)

The cam shaft 7 includes a clamping member 8 which extends along the rotational center axis of the cam phase actuator. The spaces defined between radially projecting shoes 3*a* of the case 3 and the vanes 6*a* of the second rotor 6 cooperate to form valve timing advancing hydraulic chambers 9 and valve timing retarding hydraulic chambers 10, respectively. (See FIG. 23).

Communicated to each of the valve timing advancing hydraulic chambers 9 and valve timing retarding hydraulic chambers 10 are a first oil passage (hydraulic chamber feed passage) 11 and a second oil passage 12, respectively (FIGS. 22 and 23).

A fluid-tight seal means 13 is provided at a tip end portion of the projecting shoe 3*a* of each vanes 6*a*.

A pin receiving hole 14 having a back pressure chamber 14*a* defined therein is formed in one of the vanes 6*a*, and a lock pin (lock member) 15 is accommodated within the receiving hole 14. The lock pin 15 is resiliently urged in a projecting direction (lock direction) under the influence of an urging means 16 such as a spring. (See FIG. 23).

A discharging hole 17 is formed in the back pressure chamber 14*a* of the receiving hole 14.

Communicated to the unlock hydraulic chamber 18*a* are a first unlocking hydraulic pressure feed passage 20 and a second unlocking hydraulic pressure feed passage 21 by way of a check valve 19. Exchangeably provided on the upstream side of the check valve 19 are a valve timing advancing hydraulic pressure distribution passage 22 and a valve timing retarding hydraulic pressure distribution passage 23, respectively. (See FIGS. 25, 26).

Further formed in a side wall of the receiving hole 14 is a purge passage 24 (FIGS. 25, 26) which serves to discharge through the discharging hole 17 the air trapped during stoppage of the engine, when the hydraulic pressure is fed from an oil pump (not shown) upon starting of engine operation.

By virtue of the arrangement that the air is forcibly discharged upon starting of the engine operation, a residual hydraulic pressure is generated by the oil supplied to the back pressure chamber 14*a*, whereby the unlocking of the lock pin 15 can positively be prevented (FIG. 25).

On the other hand, when the advancing hydraulic pressure is put into effect, the urging effort of the urging means 16 is overcome by the hydraulic pressure fed from the oil pump, as a result of which the tip end portion of the lock pin 15 is pushed in the unlocking direction, whereby the lock pin 15 is released from the locked state (FIG. 26).

FIG. 27 is a block diagram showing generally and schematically a structure of a conventional valve timing control apparatus for an internal combustion engine to which the present invention can find application.

Referring to FIG. 27, reference numeral 101 denotes generally an internal combustion engine which includes an air cleaner 102 for purifying the air sucked into the engine 101, an air-flow sensor 103 for measuring an intake air quantity (flow rate of the intake air) fed to the engine 101 and an intake pipe 104.

The intake pipe 104 is equipped with a throttle valve 105 for adjusting the intake air quantity (flowrate) to thereby control the output torque of the engine 101 and a fuel injector 106 for injecting an amount of fuel compatible with the intake air quantity.

Further, the internal combustion engine 101 is provided with an exhaust pipe 107 for discharging an exhaust gas resulting from combustion of the air-fuel mixture in the combustion chamber. Disposed within the exhaust pipe 107 are an $O_2$-sensor 108 for detecting a residual amount of oxygen contained in the exhaust gas and a three way catalytic converter 109.

The three way catalytic converter 109 serves to purify concurrently harmful gas components contained in the exhaust gas such as HC (hydrocarbon), CO (carbon monoxide) and $NO_x$ (nitrogen oxides).

Further, the engine 1101 is provided with a spark plug 111 adapted to be driven by an ignition coil 110. The spark plug 111 serves to generate a spark for firing the air-fuel mixture charged in the combustion chamber of the engine with high-voltage energy supplied from the ignition coil 110.

A cam angle sensor 112 provided in association with the intake valve of the engine 101 generates a pulse signal upon every passing of a projection formed in a cam angle detecting sensor plate (not shown) for thereby detecting the cam angle.

At this juncture, it should be mentioned that although only the cam angle sensor 112 provided in association with the intake valve is shown, this is only for the convenience of description. It should be understood that the cam angle sensor can of course be provided in association with the exhaust valve or both of the intake valve and the exhaust valve.

Provided in association with the intake valve and the exhaust valve of the engine 101 is a cam shaft for setting an intake/exhaust valve timing in synchronism with rotation of the crank shaft. The cam phase actuator 113 serving as the valve timing regulating means is provided in association with the cam shaft and so designed as to change the relative angle (cam phase) between the cam shaft and the crank shaft in the direction for advancing the valve timing (i.e., valve timing advancing direction) or in the direction of retarding the valve timing (i.e., valve timing retarding direction).

An oil control valve (hereinafter also referred to as OCV in abbreviation) 114 is so designed as to regulate the hydraulic pressure supplied to the cam phase actuator 113 to thereby control the cam phase of the cam shaft relative to the crank shaft.

A crank angle sensor 115 disposed in opposition to a sensor plate 116 is so designed as to generate a pulse-like signal upon every passing-by of a projection (not shown) of the sensor plate 116 to thereby detect the angular position (crank angle) of the crank shaft.

The sensor plate 116 for detecting the crank angle is mounted on the crank shaft for corotation therewith and has a tooth or projection (not shown) formed at a predetermined position.

An ECU (Electronic Control Unit) 117 which may be constituted by a microcomputer or microprocessor is so designed as to drive various types of actuators on the basis of detected information derived from the outputs of various sensors which indicate operation state of the engine 101. The ECU is in charge of controlling the cam phase in addition to the control of operation of the engine 101.

Further provided are an oil pump 118 which serves for generating a hydraulic pressure to drive the cam phase actuator 113 and feeding a lubricating oil under pressure to mechanical constituent parts of the engine 101. A hydraulic pressure sensor 119 is provided for detecting the hydraulic pressure of the lubricating oil fed under pressure to the oil control valve 114 from the oil pump 118. Further, an oil temperature sensor 120 is provided for detecting the temperature of the oil fed to the oil control valve 114 from the oil pump 118.

Cooling water 121 is recirculated around the internal combustion engine 101 for cooing it. A water temperature sensor 122 is provided for detecting temperature of the cooling water 121.

All the information detected by the various sensors mentioned above and others is inputted to the ECU 117.

Next, referring to FIGS. 22 to 26 together with FIG. 27, description will be directed to the operation of the conventional valve timing control apparatus of the structure described above.

The control of the valve timing (cam phase) is executed through the oil control valve 114 and the cam phase actuator 113 under the control of the ECU 117.

The ECU 117 is so designed or programmed as to compute or arithmetically determine a desired or target phase angle on the basis of the operation state of the engine 1101. Further, the ECU 117 arithmetically determines a detected phase angle (valve timing) on the basis of the crank angle detected by the crank angle sensor 115 and the cam angle detected by the cam angle sensor 112.

Further, the ECU 117 arithmetically determines an energizing current value (conduction current value) or duty ratio for the oil control valve 114 through feedback control based on an error between the detected phase angle and the target phase angle (i.e., deviation of the former from the latter) so that the detected phase angle coincides with the target phase angle.

The oil control valve 114 selects the oil passage for the cam phase actuator 113 and controls the valve timing by adjusting the hydraulic pressure applied to the cam phase actuator 113.

Now referring to FIGS. 22 to 26, operation of the cam phase actuator (valve timing controller or regulator) 113 will be described in more concrete. In the starting operation of the engine 1101, the oil control valve 114 is so controlled that the hydraulic medium or oil is supplied or fed to the valve timing retarding hydraulic chambers 10 of the cam phase actuator 113.

In this conjunction, it is however noted that in the state where the operation of the engine 1101 is not yet started (i.e., when the engine is stopped), there arises the possibility that the oil within the cam phase actuator 113 and the oil passage extending from the oil pump 118 to the cam phase actuator 113 may be discharged into the oil pan because no hydraulic pressure is applied.

Accordingly, when the engine operation is started, the air (or the oil containing the air) within the oil passage is introduced into the valve timing retarding hydraulic chamber 10 of the cam phase actuator 113. Then, the air (or the air containing oil) introduced into the valve timing retarding hydraulic chambers 10 is discharged exteriorly from the cam phase actuator 113 by way of the purge passage 24, the back pressure chamber 14*a* and the discharging hole 17.

Once the operation of the engine 1101 has been started, the hydraulic pressure is also introduced into the pin unlocking hydraulic chamber 18*a* from the valve timing retarding hydraulic pressure distribution passage 23. However, the lock pin 15 is held in the state retained within the retaining hole 18 under the influence of the urging means 16. In this manner, abnormal or foreign noise which would otherwise be generated due to rattling of the second rotor 6 with the lock pin 15 having been released from the retaining hole 18 in the engine starting phase can positively be suppressed.

When a driver of a motor vehicle equipped with the engine system now under consideration depresses an accelerator pedal in succession to the starting of the engine operation with a valve timing advancing command being thus issued from the ECU 117, the oil control valve 114 undergoes such control that the hydraulic pressure is introduced into the valve timing advancing hydraulic chambers 9 of the cam phase actuator 113.

Then, the oil within the valve timing advancing hydraulic chamber 9 is introduced into the pin unlocking hydraulic chamber 18*a* by way of the valve timing advancing hydraulic pressure distribution passage 22. At that time, the oil control valve 114 is controlled to the position for discharging the oil from the valve timing retarding hydraulic chambers 10. Thus, the oil within the valve timing retarding hydraulic chambers 10 is discharged into the oil pan by way of the oil control valve 114.

Consequently, the lock pin 15 is pushed outwardly from the retaining hole 18 under the hydraulic pressure to be released from the locked state. Now, the second rotor 6 is in the state to operate. More specifically, the second rotor 6 is rotated in the valve timing advancing direction under the hydraulic pressure within the valve timing advancing hydraulic chambers 9. In this way, the valve timing advancing control can be performed for the engine.

However, when the desired or target phase angle changes rapidly from the position at which the lock pin 15 is retained in the retaining hole 18, there will arise such situation that operation of the second rotor 6 starts earlier than releasing or disengaging of the lock pin 15 from the retaining hole 18.

In that case, the lock pin 15 is twisted or tangled or jammed without being withdrawn from the retaining hole 18, making it impossible for the second rotor 6 to operate in the desired direction.

Such being the circumstances, with a view to allowing the rotor 6 to operate smoothly, starting from the state in which the lock pin 15 is retained within the retaining hole 18, the ECU 117 is so designed or programmed as to limit the rate of change of the electric current supplied to the oil control valve 114 for thereby delaying or lowering the operating or moving speed of the rotor 6 so that the ordinary phase feedback control can be executed only after the operation for releasing without fail the lock pin 15 from the locked state has been carried out.

Next, description will be made of exemplary or typical cases in which the valve timing control is inhibited.

Assuming, by way of example only, that the timing for opening the intake valve is advanced, the intake valve will then be opened in the course of the suction stroke. Consequently, the inactive gas is caused to flow backwardly toward the intake side, which will result in that the inactive gas is again charged into the cylinder of the engine 101 in the suction stroke. Consequently, the heat capacity of the air-fuel mixture within the cylinder increases, which incurs lowering of the burning velocity.

When the advancing control of the intake valve open timing is carried out in the cold state of the internal combustion engine, the burning velocity lowers remarkably because it is intrinsically low when the engine 101 is in the state of low temperature, involving thus occurrence of misfire event and fluctuations of the combustion which may unwantedly degrade the drivability of the engine.

For the reasons mentioned above, the ECU 117 is so designed or programmed as to inhibit the control for advancing the intake valve open timing with the aim of suppressing the misfire event and the fluctuation or variation of the combustion when the detected water temperature derived from the output of the water temperature sensor 122 (i.e., the temperature of the cooling water 121 of the engine 101) is lower than a predetermined time.

On the other hand, when the temperature of the cooling water 121 of the engine 101 exceeds the predetermined time, the ECU 117 invalidates or clears the inhibited state of the valve timing advancing control to thereby allow the phase feedback control to be enabled.

In that case, at the time point when the inhibited state of the valve timing advancing control is cleared, the rate of change (also referred to as the change quantity) of the valve timing is limited by limiting the change rate or quantity that of the target phase angle with a view to preventing occurrence of variation or fluctuation of the output torque which may be brought about by abrupt change of the valve timing.

However, in the case where the cam phase actuator is employed which requires unlocking of the lock pin 15 before changing the valve timing such as typified by the one described hereinbefore by reference to FIGS. 22 to 26, the unlocking operation of the lock pin 15 is started from a time point at which the target phase angle has exceeded the predetermined angle with the electric current supplied to the oil control valve 114 being changed slowly.

In that case, the start of change of the valve timing is accompanied with a time lag as compared with the ordinary phase feedback control. Consequently, deviation of the detected phase angle from the target phase angle, i.e., error between the detected phase angle and the target phase angle becomes large at the time point when the unlocked state of the lock pin 15 is detected after the detected phase angle has advanced up to a predetermined angle.

When changeover to the phase feedback control is performed at this time point, the current supplied to the oil control valve 114 becomes large due to a large phase angle error (deviation or difference) between the target phase angle and the detected phase angle, incurring rapid or abrupt change of the valve timing.

If the valve timing changes rapidly in this manner, the output torque of the engine 101 will change, which may result in occurrence of a shock unexpectedly to the driver, to his or her uncomfortableness.

This situation will be described below by reference to FIG. 28 which is a timing chart illustrating how the detected phase angle θa (valve timing) changes as a function of time lapse in the lock pin release control in the conventional apparatus.

In FIG. 28, time is taken along the abscissa with the advance quantity (deg. CA) of the cam phase actuator being taken along the ordinate. As can be seen in FIG. 28, from a time point tps at which the target phase angle θtw which is limited in consideration of the water temperature as ascribed previously (hereinafter also referred to as the water-temperature-limited target phase angle) increases to exceed the predetermined angle (e.g. 5 [deg. CA]), the detected phase angle θa starts to increase, whereupon the control for unlocking the lock pin 15 is started.

On the other hand, the water-temperature-limited target phase angle θtw has already reached a base target phase angle θmap at the time point at which the released state of the lock pin 15 is detected. Consequently, if the phase feedback control is performed from this time pint tpe, the detected phase angle θa changes steeply, as can be seen in the figure. As a result of this, the driver experiences unexpectedly a shock due to change of the output torque of the engine.

The conventional valve timing control apparatus for the internal combustion engine suffers a problem that in the case where the cam phase actuator described hereinbefore in conjunction with FIGS. 22 to 26 is employed, changeover to the phase feedback control at the time point tpe when the detected phase angle has advanced up to the predetermined angle (i.e., when the released state of the lock pin 15 is detected), the valve timing changes steeply (see FIG. 28), bringing about change or fluctuation in the output torque of the engine 101 and hence shocks unexpectedly to the driver, to his or her uncomfortableness.

SUMMARY OF THE INVENTION

In the light of the state of the art described above, it is an object of the present invention to provide a valve timing control apparatus for an internal combustion engine in which occurrence of a shock unexpectedly to the driver upon changeover to the phase feedback control can be suppressed even in the case where the cam phase actuator which requires operation for releasing the lock pin from the locked state in advance upon changing of the valve timing is employed.

In view of the above and other objects which will become apparent as the description proceeds, there is provided according to a general aspect of the present invention a valve timing control apparatus for an internal combustion engine, which apparatus includes a cam shaft rotatable in synchronism with rotation of a crank shaft of the internal combustion engine for thereby setting valve timing for at least one of an intake valve and an exhaust valve of the engine, a cam phase actuator having a valve timing advancing hydraulic chamber and a valve timing retarding hydraulic chamber to which hydraulic pressure is fed for changing a relative angle of the cam shaft to the crank shaft in a valve timing advancing direction or alternatively in a valve timing retarding direction, a locking mechanism provided in association with the cam phase actuator for locking the relative angle at a predetermined relative angle, an oil pump for generating the hydraulic pressure, a hydraulic pressure regulating means for feeding the hydraulic pressure to the valve timing advancing hydraulic chamber or alternatively to the valve timing retarding hydraulic chamber, and an engine control unit for controlling the hydraulic pressure regulating means.

In the valve timing control apparatus, the locking mechanism is released under the effect of the hydraulic pressure fed to either one of the valve timing advancing hydraulic chamber or the valve timing retarding hydraulic chamber of the cam phase actuator upon changing of the relative angle, while when the relative angle is to be changed from the locked state validated by the locking mechanism, a phase feedback control of the relative angle is performed after having executed a control for releasing the locked state in advance.

Further, the engine control unit mentioned above includes a change quantity limiting means for limiting a change quantity of the valve timing. This means is so designed as to limit the change quantity of the valve timing to a predetermined value upon transition of the locked state releasing control to the phase feedback control.

By virtue of the arrangement described above, there can be realized the valve timing control apparatus for the engine, which apparatus is capable of suppressing positively occurrence of the shock unexpected by the driver upon transition to the phase feedback control, even in the case where the cam phase actuator which requires operation for releasing the lock pin from the locked state in advance upon changing of the valve timing is employed.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 4 is a view for illustrating a three-dimensional map (data table) for arithmetically determining a target phase angle on the basis of a rotation speed and a charging efficiency of the engine according to the first embodiment of the invention;

FIG. 14 is a view showing a two-dimensional table for arithmetically determining a change rate of the target phase angle on the basis of a change quantity of the throttle opening degree in the apparatus according to the second embodiment of the invention;

FIG. 19 is a view showing a two-dimensional table for arithmetically determining a change rate of the target phase angle on the basis of the change quantity of the charging efficiency in the apparatus according to the third embodiment of the invention;

DESCRIPTION OF THE PREFERRED EMBODIMENTS

Figure 1:
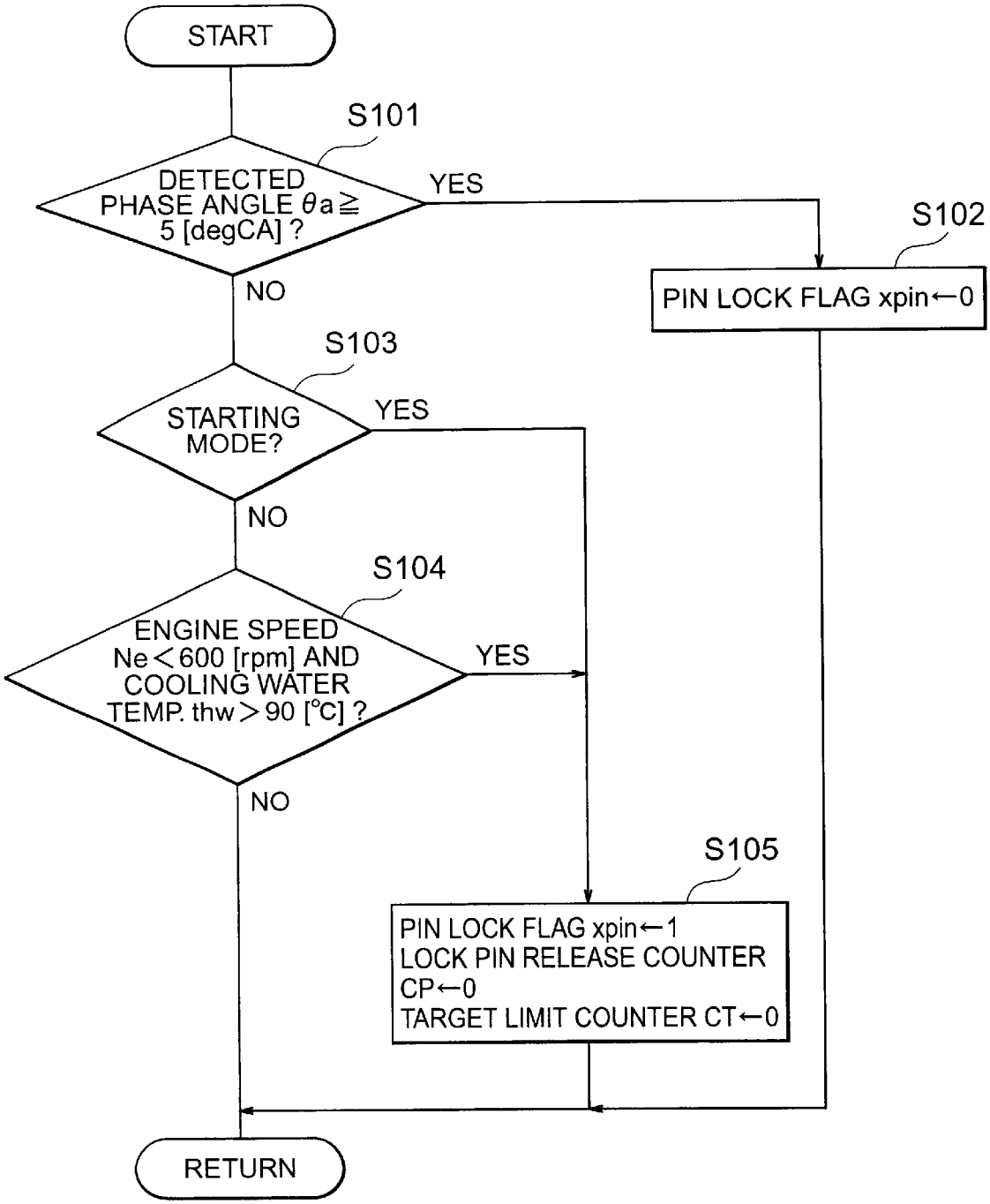
FIG. 1 is a flow chart showing a processing routine for determining a locked state of a lock pin in a valve timing control apparatus according to a first embodiment of the present invention.

The present invention will be described in detail in conjunction with what is presently considered as preferred or typical embodiments thereof by reference to the drawings. In the following description, like reference characters indicate like or corresponding contents throughout the several views.

Embodiment 1

Now, the valve timing control apparatus for an internal combustion engine according to a first embodiment of the present invention will be described in detail by reference to the drawings.

Figure 27:
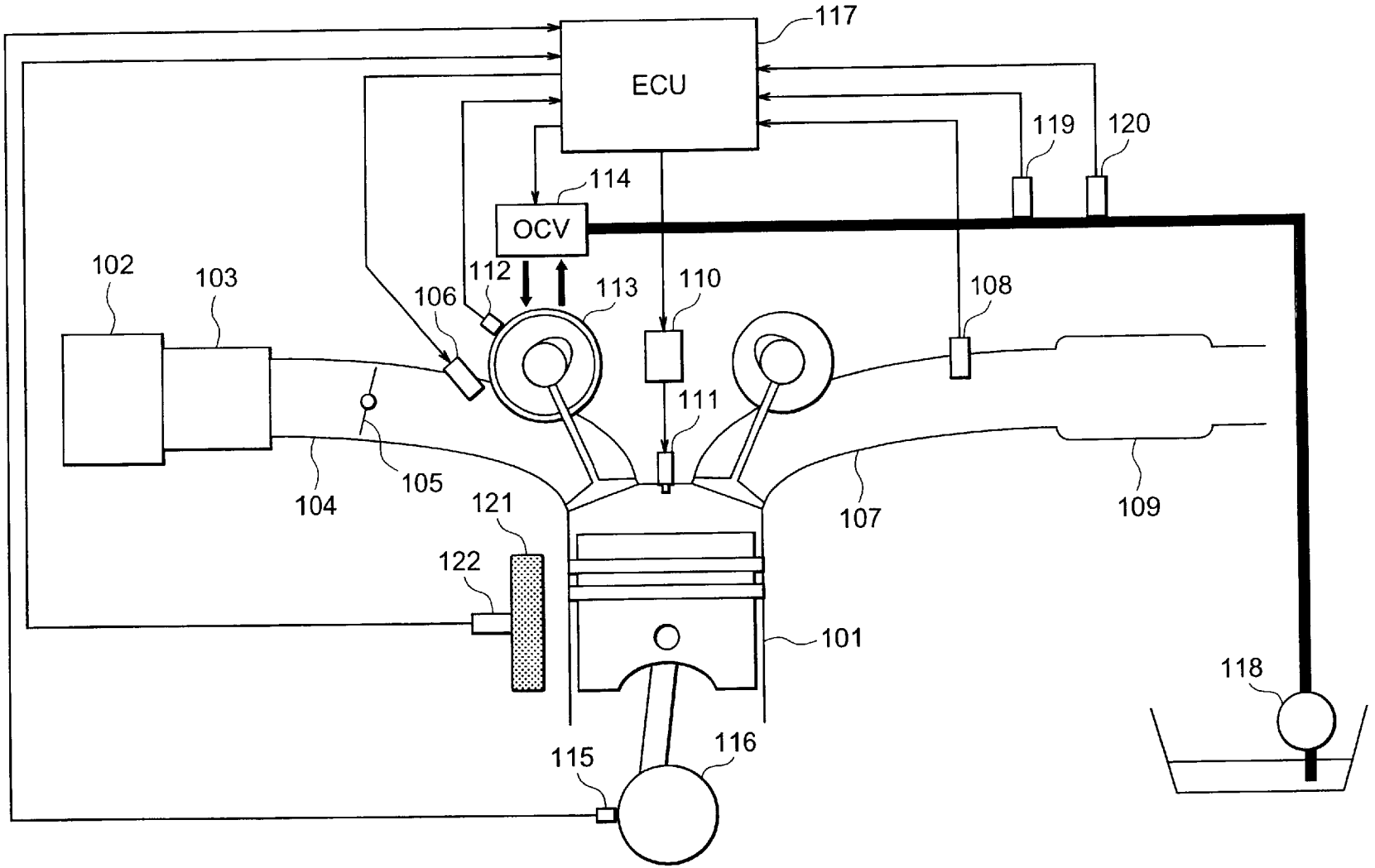
FIG. 27 is a block diagram showing generally and schematically a structure of a conventional valve timing control apparatus for an internal combustion engine.

Incidentally, the general structure or arrangement of the valve timing control apparatus according to the instant embodiment is essentially same as that of the conventional one described hereinbefore in conjunction with FIG. 27. Difference from the latter is seen only in that several processings executed by the ECU 117 are altered or modified. Further, it is presumed that the cam phase actuator 113 employed in realizing the instant embodiment is essentially same as that described previously by reference to FIGS. 22 to 26.

More specifically, it is presumed that the cam phase actuator 113 is provided with such oil passage arrangement which is capable of releasing the lock pin 15 from the locked state only with the hydraulic pressure effective for advancing the valve timing with the retaining hole 18 for the lock pin 15 being disposed at the most retard position (i.e., the angular position at which the valve timing is most retarded).

FIGS. 1 to 11 are views for illustrating operations of the valve timing control apparatus according to the first embodiment of the invention, in which FIGS. 1 to 3 and FIGS. 5 to 9 are flow charts for illustrating processings executed by the ECU (Electronic Control Unit) incorporated in the valve timing control apparatus according to the first embodiment of the invention.

FIG. 4 shows a view for illustrating a three dimensional map (data table) which is referenced for arithmetically determining or computing a base target phase angle θmap in the valve timing control apparatus according to the instant embodiment of the invention on the presumption that the base target phase angle θmap is determined on the basis of a rotation speed (rpm) Ne and a charging efficiency Ce of the engine.

Figure 10:
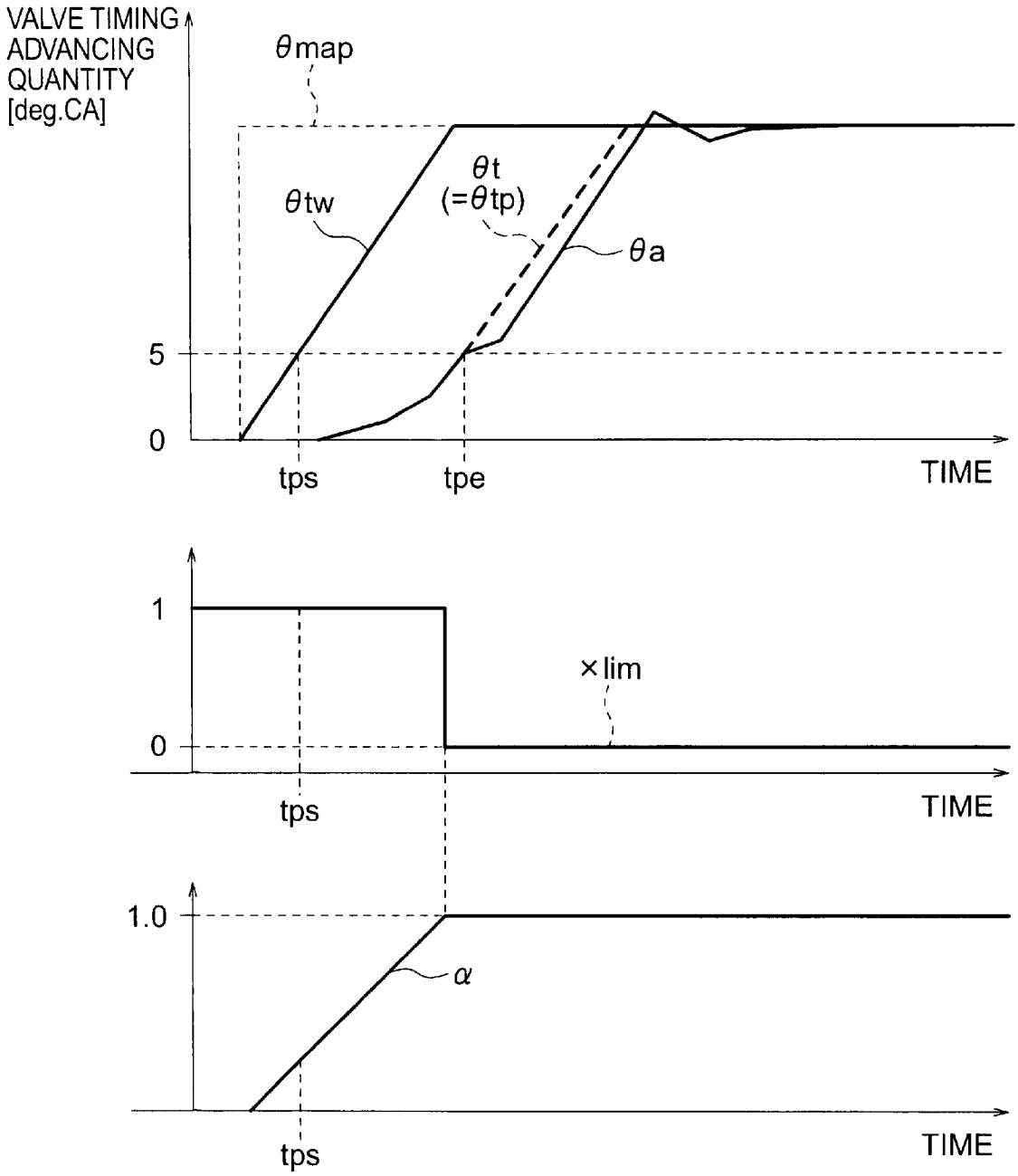
FIG. 10 is a timing chart for graphically illustrating behavior of detected phase angle when absence of torque demand is determined at a time point an execute request for lock pin release control is issued in the apparatus according to the first embodiment of the invention.
Figure 11:
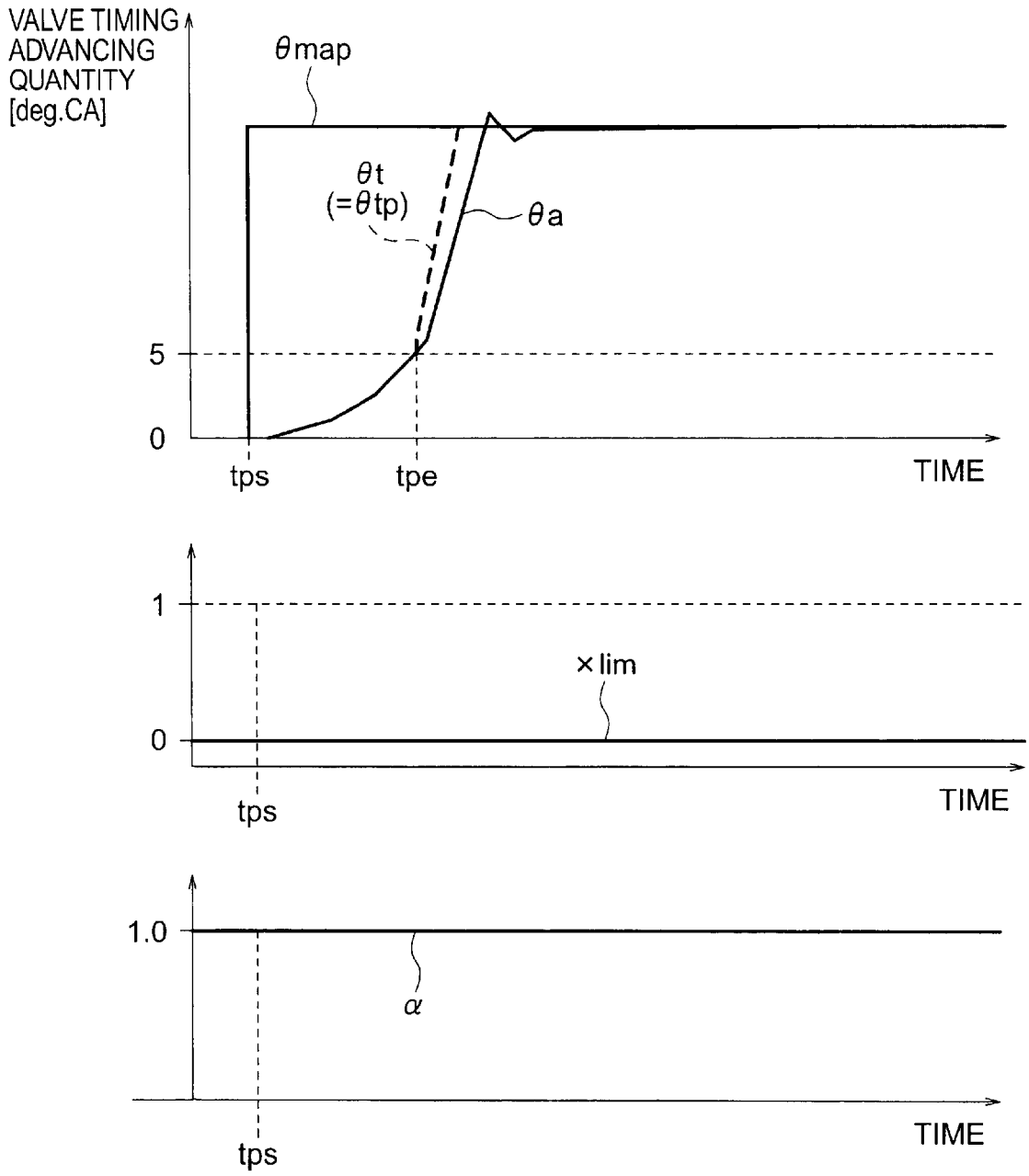
FIG. 11 is a timing chart for graphically illustrating behavior of detected phase angle when presence of torque demand is determined at a time point an execute request for lock pin release control is issued in the apparatus according to the first embodiment of the invention.

Further, FIGS. 10 and 11 are timing charts for graphically illustrating change of the base target phase angle θmap as a function of time in the valve timing control apparatus according to the first embodiment of the invention.

In the description which follows, it is presumed, by way of example, that a relative angle of the intake cam shaft relative to the crank shaft (i.e., valve timing) is to be controlled.

FIG. 1 shows a processing routine for determining the locked state of the lock pin 15.

Referring to FIG. 1, decision is made in a step S101 whether or not a detected phase angle θa is equal to or greater than a predetermined angle (e.g. 5 [deg. CA]). When it is decided that θa≧the predetermined angle (i.e., when the step S101 results in affirmation "YES"), a pin-lock flag xpin is set to "0" in a step S102, whereupon the processing routine shown in FIG. 1 comes to an end [Return].

In this conjunction, it is to be noted that the state where the detected phase angle θa is greater than the predetermined angle inclusive thereof indicates that the second rotor 6 is capable of operating in the valve timing advancing direction with the lock pin 15 being released from the retaining hole 18. Thus, it is determined that the lock pin 15 has been cleared or released from the locked state.

Parenthetically, the pin lock flag xpin is set to "1" in the locked state while being set to "0" in the unlocked or released state.

On the other hand, when it is determined in the step S101 that the detected phase angle θa is smaller than the predetermined angle θa (i.e., when the decision step S101 results in negation "NO"), decision is then made in a step S103 whether or not the engine 101 is in the starting mode.

When it is determined in the step S103 that the engine 101 is not in the starting mode (i.e., when the step S103 results in "NO"), decision is then made in a step S104 whether the engine rotation speed (rpm) Ne is lower than a predetermined speed (e.g. 600 [rpm]) and whether the cooling water temperature thw is higher than a predetermined temperature (e.g. 90 [° C.]).

By contrast, when it is determined in the step S103 that the engine 101 is in the starting mode (i.e., when the step S103 results in "YES"), it is then determined that the lock pin 15 is retained in the retaining hole 18 (i.e., the lock pin 15 is in the locked state) with no hydraulic pressure being generated by the oil pump 118 in the stopped state of the engine 101, as described hereinbefore. In that case, the pin-lock flag xpin is set to "1" in a step S105, whereupon the processing routine shown in FIG. 1 comes to an end [Return].

Additionally, in the step S105, a lock pin release counter CP (described later on by reference to FIG. 8) is set to "0" while a target limit counter CT operated after the lock pin has been released is set to "0", as will be described hereinafter by reference to FIG. 9.

Further, when it is determined in the step S104 which is executed in succession to the step S103 resulting in "NO" that Ne<predetermined speed (e.g. 600 [rpm])and that thw>predetermined temperature (e.g. 90[° C.]), i.e., when the step S104 results in "YES" then the processing proceeds to the step S105.

By contrast, when it is determined in the step S104 that Ne≧predetermined speed and/or that thw≦predetermined temperature (i.e., when the step S104 results in "NO"), the processing routine shown in FIG. 1 is terminated straightforwardly.

In this manner, when it is determined in the step S103 that the engine is not in the starting mode (i.e., when the step S103 is "NO") and determined in succession in the step S104 that Ne≧predetermined speed and/or thw≦predetermined temperature (i.e., when the step S104 is "NO"), then the value of the pin lock flag xpin set in the past remains as it is.

Consequently, in the case where the engine 101 has once been in the starting mode or alternatively when the rotation speed Ne is lower than the predetermined speed and when the cooling water temperature thw is higher than the predetermined temperature, the pin lock flag xpin remains set to "1".

Since the lock pin 15 can not be released from the retaining hole 18 unless the hydraulic medium or oil is introduced into the valve timing advancing hydraulic chamber 9, the state of the pin lock flag xpin coincides with the actual state of the lock pin 15.

Figure 2:
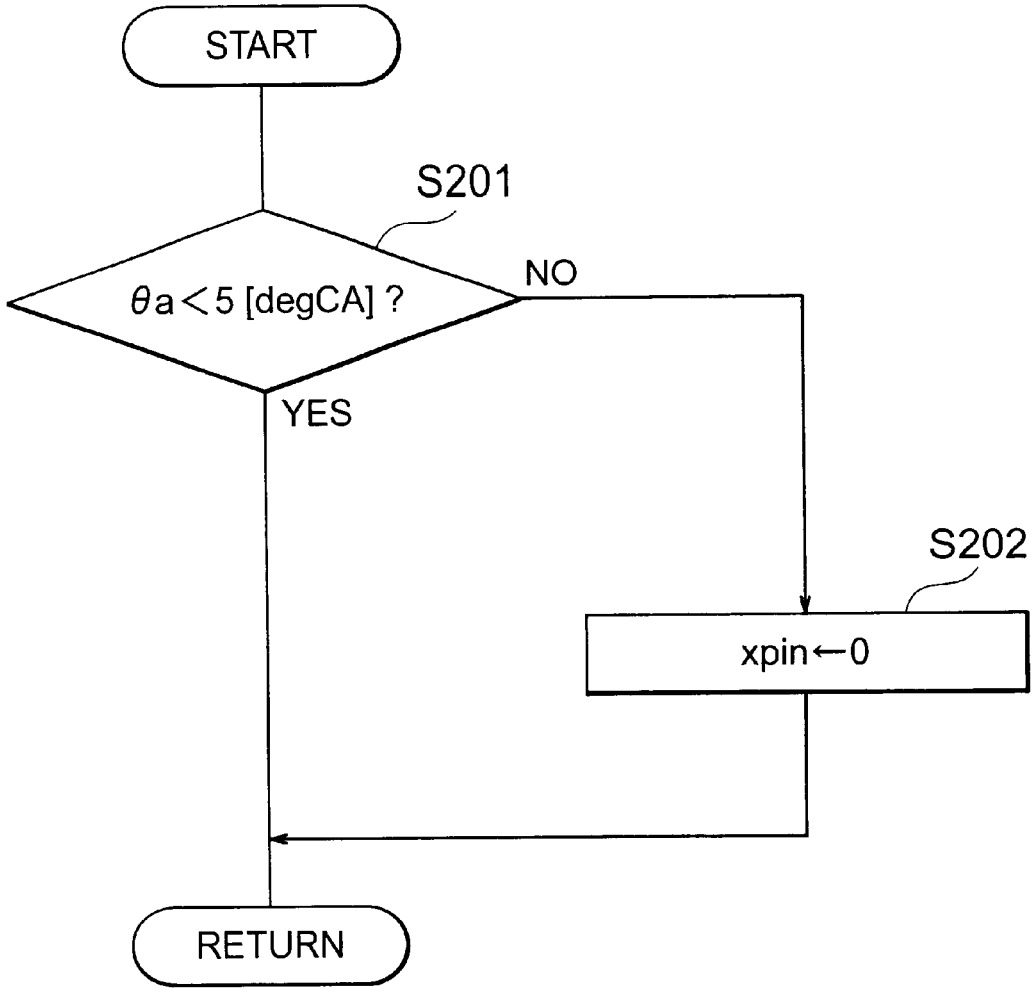
FIG. 2 is a flow chart showing a processing routine for determining a released state of the lock pin in the apparatus according to the first embodiment of the invention.

FIG. 2 shows a processing routine for determining the released state of the lock pin 15.

Referring to FIG. 2, decision is firstly made in a step S201 whether or not the detected phase angle ea is smaller than a predetermined angle (e.g. 5 [deg. CA]).

When it is determined in the step S201 that θa≧the predetermined angle (i.e., when the step S201 results in "NO"), this means that the lock pin 15 has been released from the locked state and that the valve timing has advanced sufficiently. Consequently, the pin-lock flag×pin is cleared or reset to "0" in a step S202, whereupon the processing routine shown in FIG. 2 comes to an end [Return].

On the other hand, when it is dete_ined that θa<the predetermined angle (i.e., when the step S201 is "YES"), the processing routine shown in FIG. 2 is terminated straightforwardly. [Return].

Figure 3:
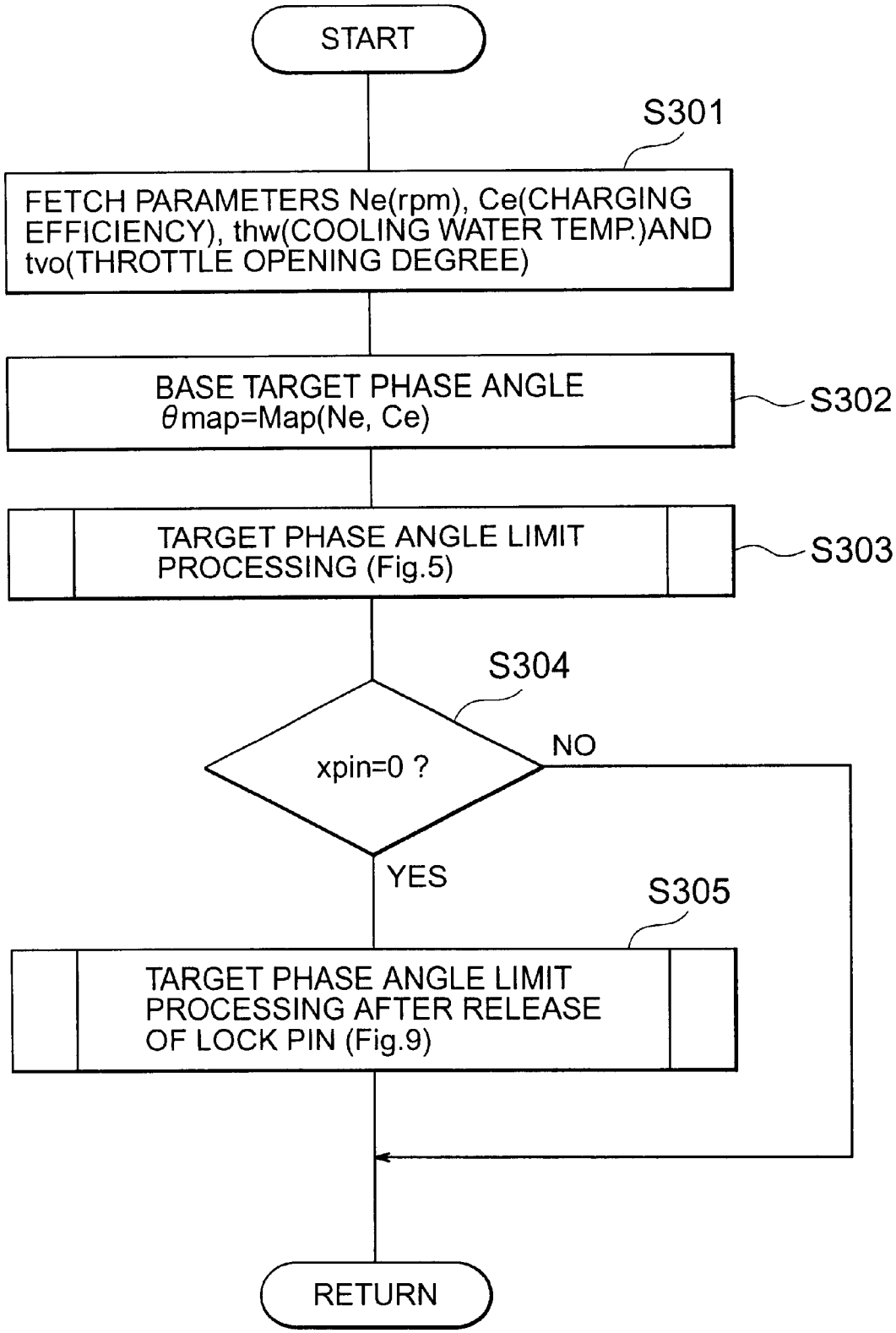
FIG. 3 is a flow chart showing a processing procedure for arithmetically determining a base target phase angle in precedence to validation of various limitations in the apparatus according to the first embodiment of the invention.

FIG. 3 is a flow chart showing a processing routine which is executed before various limitations are validated. More specifically, this flow chart shows a processing routine for computing the base target phase angle θmap on the basis of the operation state of the engine 101.

Referring to FIG. 3, parameters (output values of various sensors) indicating the operation state of the engine 101 are firstly fetched in a step S301 to arithmetically determine or compute the base target phase angle θmap by referencing the table data of the three dimensional map of the engine rotation speed Ne and the charging efficiency Ce (see FIG. 4) in a step S302.

Incidentally, "Map(Ne, Ce)" shown in the step S302 represents a function for computing the base target phase angle θmap on the basis of the rotation speed Ne and the charging efficiency Ce by referencing the three dimensional map shown in FIG. 4.

Subsequently, limitation is imposed on the base target phase angle θmap by executing a target phase angle limit processing (described later on by reference to FIG. 5) in a step S303, whereon it is decided whether or not the pin lock flag xpin is "0" in a step S304.

When it is determined in the step S304 that xpin="0" (i.e., when the step S304 is "YES"), a final or ultimate target phase angle θt (the phase angle subjected to limitation after the lock pin has been released) which is used for the phase feedback control is computed through a target phase angle limit processing executed after the lock pin has been released (described herein after by reference to FIG. 9) in a step S305, whereupon the processing routine shown in FIG. 3 comes to an end [Return]).

On the other hand, when it is determined that xpin="1" (i.e., when the step S304 is "NO"), the processing routine shown in FIG. 3 is terminated straightforwardly.

Next, the processing routine for limiting the base target phase angle θmap computed through the routine shown in FIG. 3 will be described by referring to the flow chart shown in FIG. 5.

In this processing, the most retard position is set by inhibiting the valve timing control when the cooling water temperature thw is lower than a predetermined temperature (e.g. 0 [° C.]) in the engine starting made regardless of the value of the base target phase angle θmap.

When the cooling water temperature thw attains or exceeds the predetermined temperature (e.g. 0 [° C.]) as the warm-up operation of the engine 101 proceeds, limitation imposed to the final or ultimate target phase angle θt is mitigated or loosened to thereby allow the phase angle to change gradually from the most retard angler position to the base target phase angle θmap.

Figure 5:
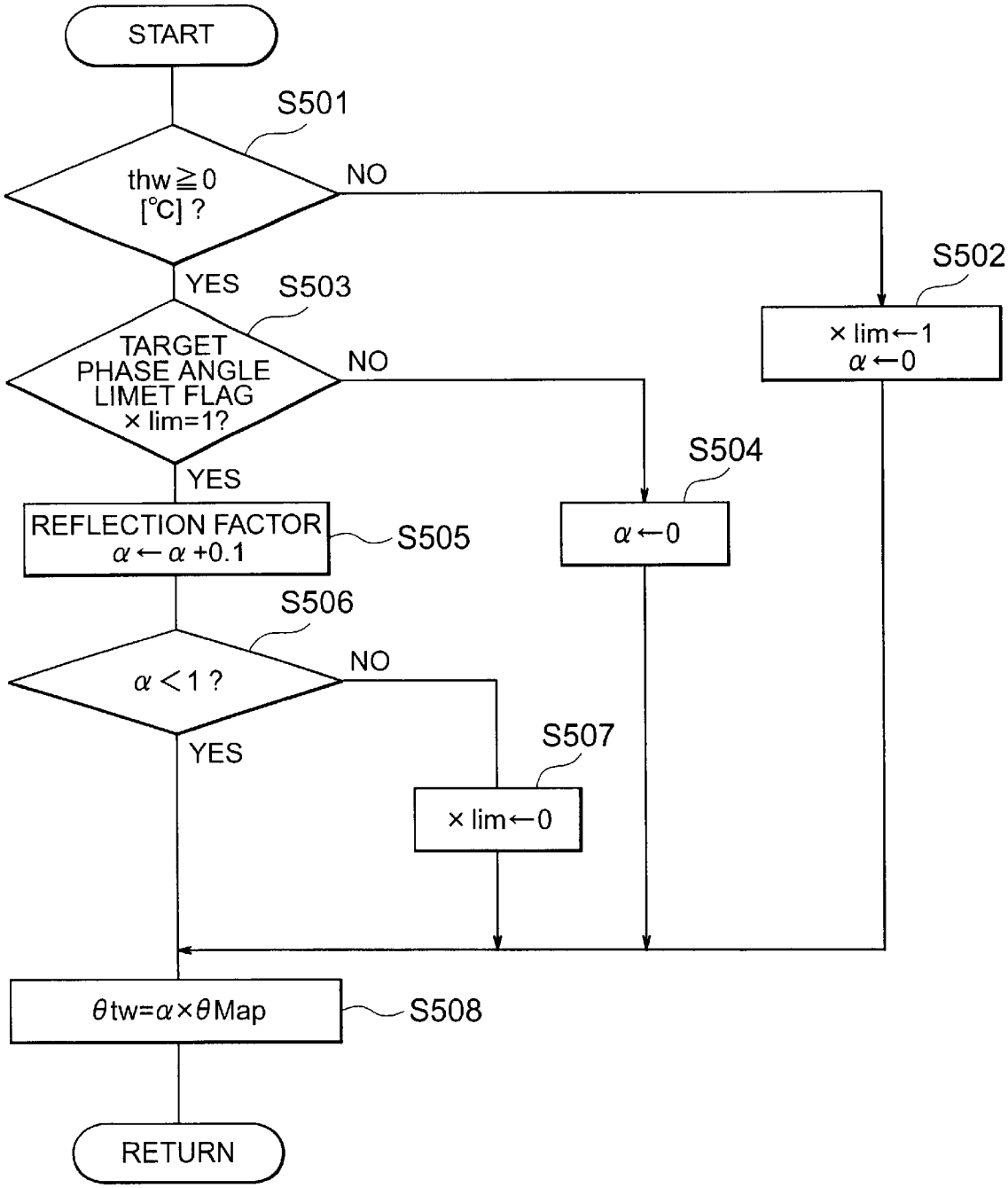
FIG. 5 is a flow chart showing a processing procedure for limiting the base target phase angle in dependence on an engine cooling water temperature in the apparatus according to the first embodiment of the invention.

Referring to FIG. 5, it is firstly decided whether or not the cooling water temperature thw is higher than the predetermined temperature (0 [° C.]) inclusive thereof in a step S501. When it is determined that thw <predetermined temperature (i.e., when the step S501 is "NO"), a target phase angle limit flag xlim is set to "1" while the reflection factor α of the base target phase angle θmap is cleared to "0" (step S502), whereon the processing proceeds to a step S508 (described later on).

By contrast, when it is determined in the step S501 that thw≧predetermined temperature (i.e., when the step S501 is "YES"), decision is then made in a step S503 whether or not the target phase angle limit flag xlim is set to "1" (i.e., whether or not the base target phase angle θmap is in the limited state).

The target phase angle limit flag xlim is cleared to "0" when the key switch of the engine 101 is closed while it is set to "1" when the base target phase angle θmap is in the limited state. Unless limitation is imposed on the base target phase angle θmap, the target phase angle limit flag xlim is set to "O".

When it is determined in the step S503 that xlim=0 (i.e., when the step S503 is "NO"), the reflection factor α is set to "1" in the step S504, whereon the processing proceeds to the step S508.

On the contrary, when it is determined in the step S503 that xlim="1" (i.e., when the step S503 is "YES"), the reflection factor α is incremented by a predetermined value (e.g. 0.1) in a step S505, whereon decision is made whether or not the reflection factor α is smaller than "1" in a step S506.

When it is determined in the step S506 that α≧1 (i.e., when the decision step S506 is "NO"), the target phase angle limit (valve timing control inhibit) flag xlim is reset to "0" in a step S507, whereon the processing proceeds to the step S508.

On the other hand, when it is determined in the step S506 that $\alpha<1$ (i.e., when the step S506 is "YES"), the water-temperature-limited target phase angle θtw is arithmetically determined in accordance with the following expression (1) in the step S508, whereon the processing routine shown in FIG. 5 comes to an end.

$$\theta tw=\alpha\times\theta map \quad (1)$$

Figure 6:
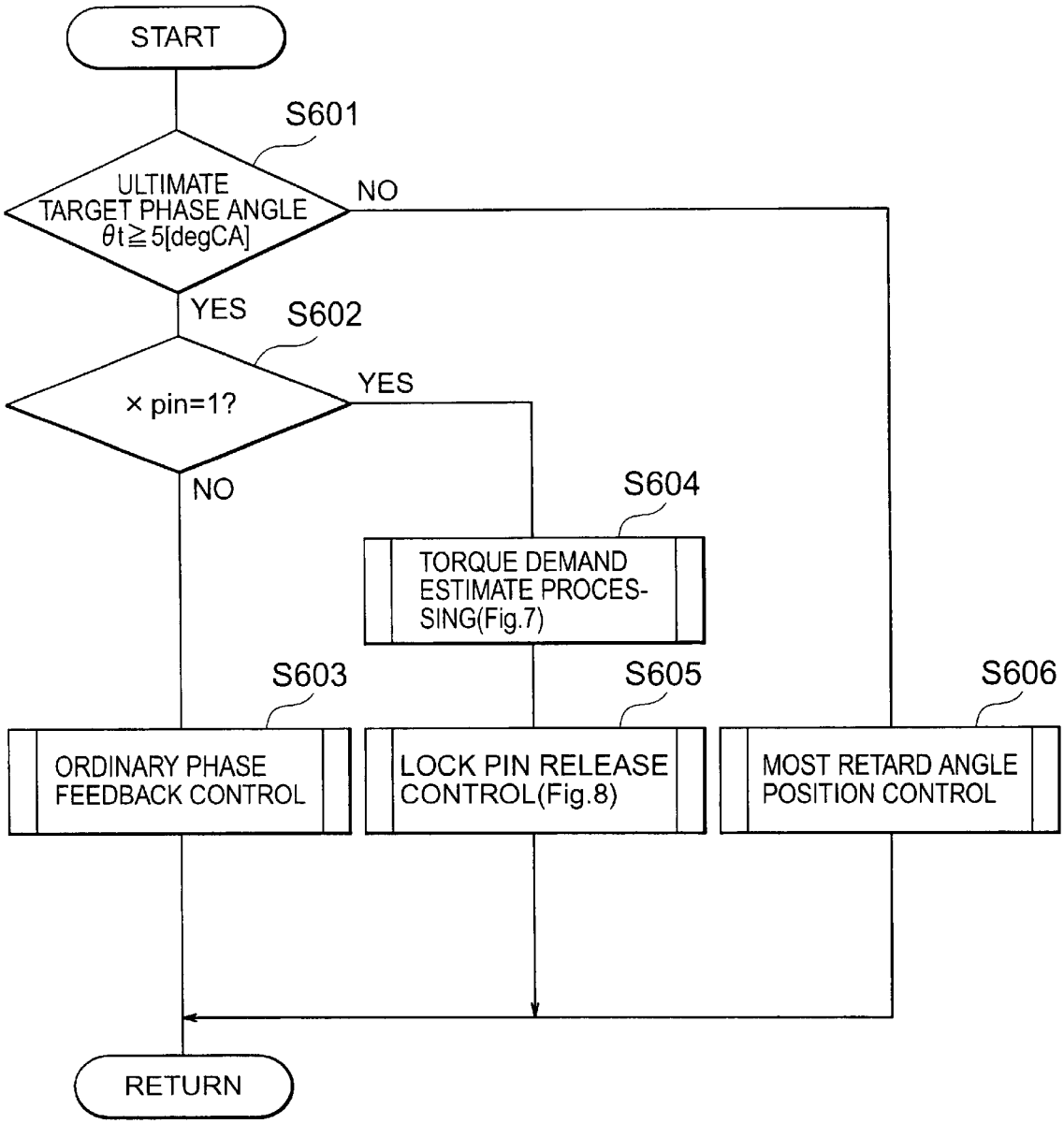
FIG. 6 is a flow chart showing a processing routine for a phase angle control in the apparatus according to the first embodiment of the invention.

FIG. 6 shows a processing routine for the phase angle control.

Referring to the figure, decision is made in a step S601 whether or not the final or ultimate target phase angle θt is greater than a predetermined angle (e.g. 5 [deg. CA]) inclusive. When it is determined that θt≧the predetermined angle (i.e., when the step S601 is "YES"), then decision is made in a step S602 whether or not the pin lock flag xpin is "1".

When it is determined in the step S602 that xpin="0" (i.e., "NO"), the ordinary phase feedback control is carried out (step S603), whereon the processing routine shown in FIG. 6 is terminated [Return].

On the other hand, when the decision step S602 results in that xpin="1" ("YES"), a torque demand estimate processing (described hereinafter by referring to FIG. 7) is executed in a step S604 to estimate the torque demand at the time point when the execution request for the lock pin release control is issued.

Furthermore, in succession to the torque demand estimate processing (step S604), a lock pin release control processing (described hereinafter by reference to FIG. 8) is executed, whereon the processing routine shown in FIG. 6 is terminated.

On the other hand, when it is determined in the step S601 that θt<the predetermined angle (i.e., S601 is "NO"), the most retard angle position control is executed (step S606), and then the processing routine shown in FIG. 6 is terminated without performing the valve timing advancing control.

Figure 7:
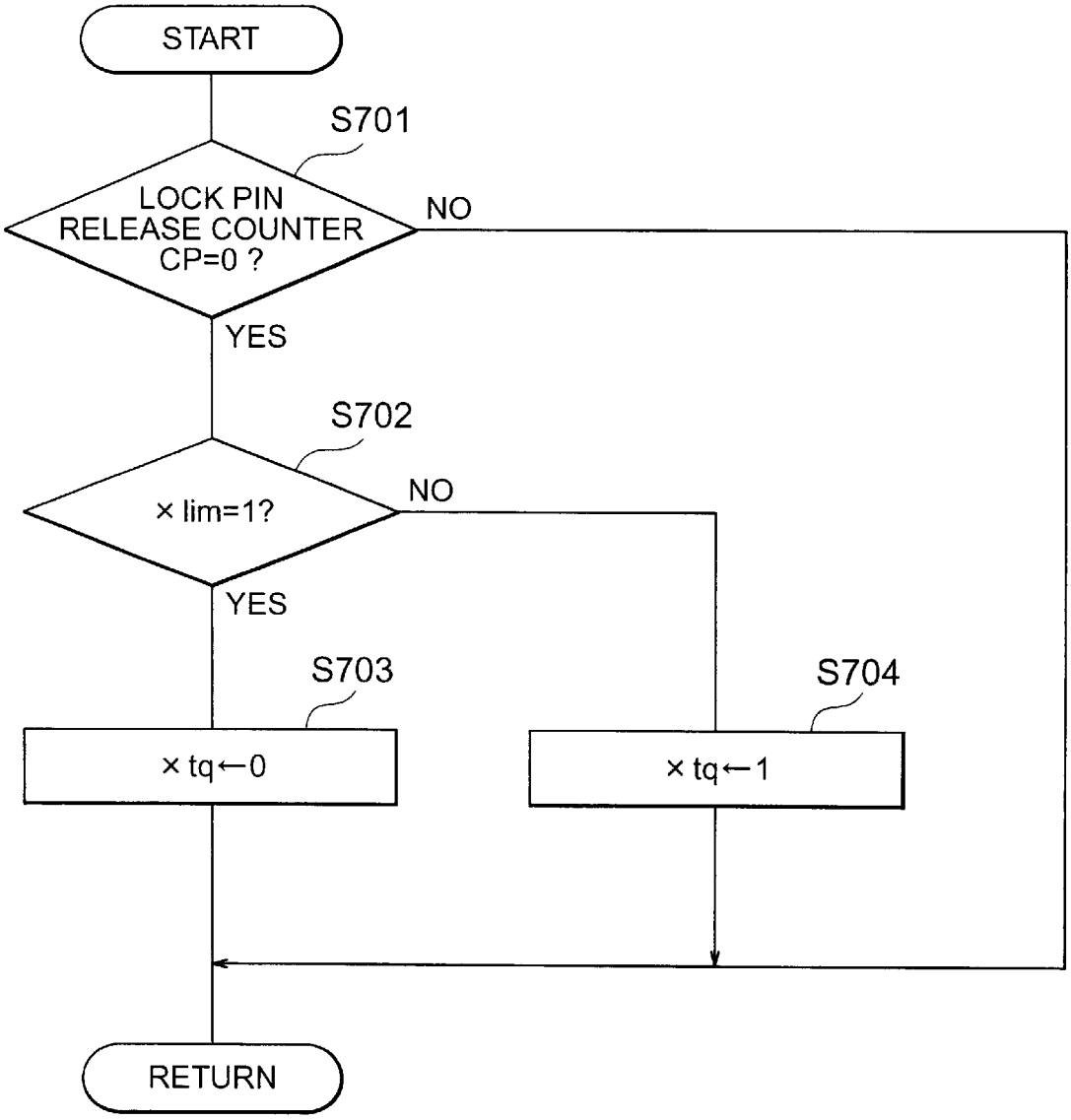
FIG. 7 is a flow chart showing a processing procedure for estimating presence/absence of a torque demand at a time point when an execution request for lock pin release control is issued in the apparatus according to the first embodiment of the invention.

FIG. 7 shows a processing routine for estimating whether or not the torque demand has been issued at the time point when the execution request for the lock pin release control is issued.

Referring to FIG. 7, decision is firstlymade whether or not the lock pin release counter CP is "0" (step S701). When it is determined that CP="1" ("YES"), then decision is made in a step S702 whether or not the target phase angle limit flag xlim is "1".

When it is determined in the step S701 that CP>0 (i.e., "NO"), this means that the lock pin release control is already in progress. In this case, the routine shown in FIG. 7 is terminated without executing any processing.

Further, when it is determined in the step S702 that xlim="1" (i.e., "YES"), this indicates that the base target phase angle θmap is limited in consideration of the cooling water temperature thw. Accordingly, it is determined that the lock pin release control has been executed. Thus, the torque demand flag xtq is reset or cleared to "0" (step S703), whereon the processing routine shown in FIG. 7 is terminated.

By contrast, when the decision step S702 results in that xlim "0" (i.e., "NO"), the torque demand flag xtq is set to "1" (step S704), and the processing routine shown in FIG. 7 is terminated.

At this juncture, it should be mentioned that the torque demand flag xtq is set to "1" in the case where it can be decided that the driver has issued the torque demand, whereas the torque demand flag xtq is reset to " " when no torque demand has been issued.

Figure 8:
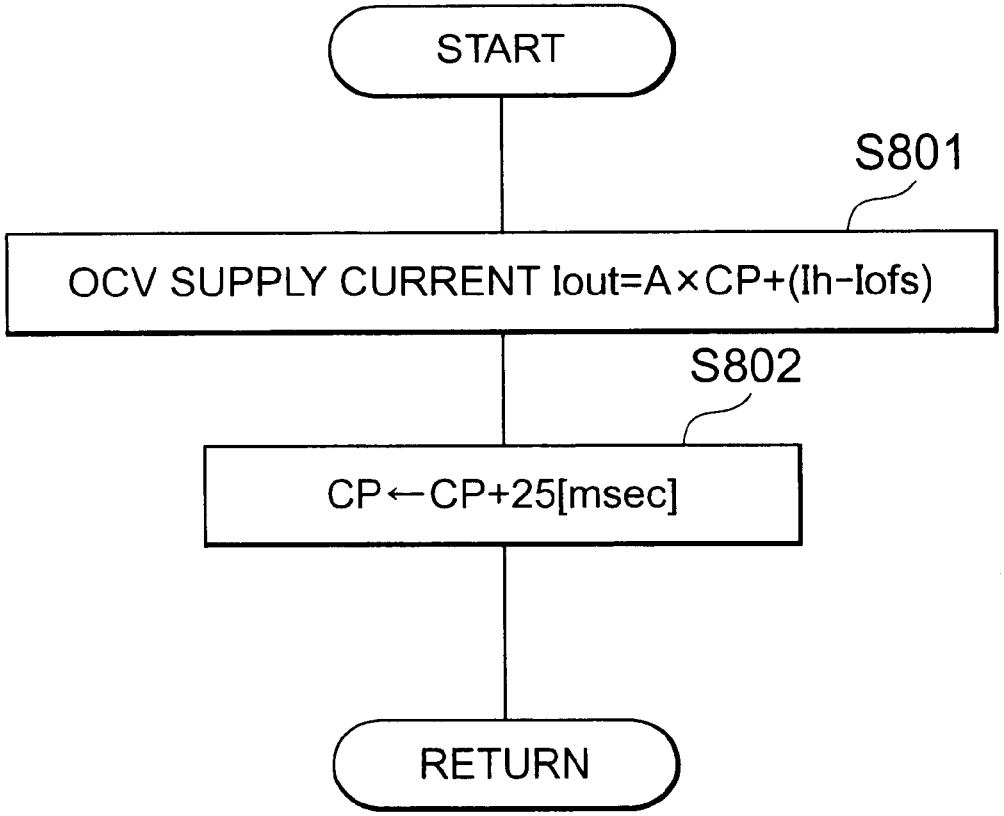
FIG. 8 is a flow chart showing a processing routine for arithmetically determining an electric current fed to an oil control valve for lock pin release control in the apparatus according to the first embodiment of the invention.

FIG. 8 shows a processing routine for arithmetically determining or computing the current fed to the oil control valve 114 in the lock pin release control.

Referring to the figure, in a step S801, the supply current Iout fed to the oil control valve 114 is computed in accordance with the undermentioned expression (2) in a step S801.

$$Iout=A\times CP+(Ih-Iofs) \quad (2)$$

where Ih represents a hold current value (e.g. 500 [mA]) fed to the oil control valve 114 for holding the valve timing control apparatus at a predetermined angular position. Further, Iofs represents an offset current (e.g. 200 [mA]) for gradually increasing the current Iout fed to the oil control valve 114 from a value somewhat undermined than the hold current value Ih. Further, A represents a current increasing rate (e.g. 0.1 mA/sec) for increasing gradually the supply current Iout, and CP represents the counter value of the lock pin release counter.

Subsequently, the counter value of the lock pin release counter CP is incremented by a value corresponding to the time period (e.g. 25 [m/sec]) for the processing routine shown in FIG. 8 (step S802), whereupon this processing routine comes to an end [Return].

Figure 9:
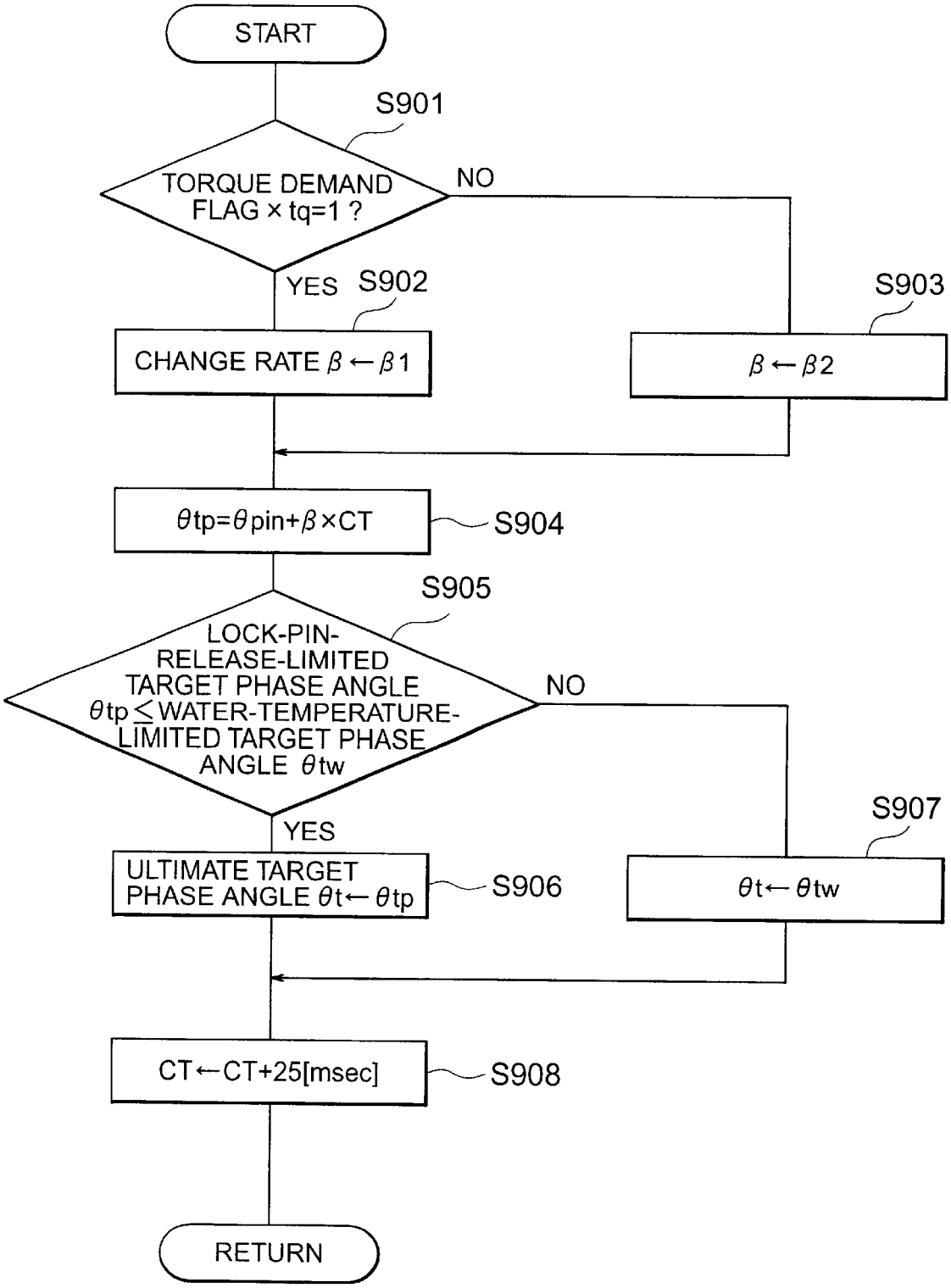
FIG. 9 is a flow chart showing a processing routine for limiting a water-temperature-limited target phase angle immediately after detection of released state of the lock pin in the apparatus according to the first embodiment of the invention.

FIG. 9 is a flow chart for illustrating a processing routine for limiting the water-temperature-limited target phase angle θtw immediately after detection of the released state of the lock pin 15.

In the processing routine shown in FIG. 9, limitation imposed on the water-temperature-limited target phase angle θtw is changed over in dependence on presence or absence of the torque demand at the time point when the execution request for the lock pin release control has been issued.

Referring to FIG. 9, decision is firstly made whether or not the torque demand flag xtq is "1" (step S901). When it is determined in the step S901 that xtq="1", then the rate β of change (hereinafter also referred to as the change rate) of the ultimate target phase angle θt is set to "β1" (step S902), while when the decision step S901 results in that xtq="0" (i.e., when step S901 is "NO"), the change rate β is set to β2 (<β1) in a step S903.

In succession, in a step S904, the lock-pin-release-limited target phase angle θtp is computed in accordance with the undermentioned expression (3):

$$\theta tp=\theta pin+\beta\times CT \quad (3)$$

where θpin represents the predetermined angle employed in the step S201 shown in FIG. 2 (decision as to release of the lock pin 15), and CT represents a time counter designed for counting up from the time point at which the release of the lock pin 15 is detected. Thus, the count value of the counter CT represents the time lapse after the lock pin was released.

In secession, the lock-pin-release-limited target phase angle θtp is compared with the water-temperature-limited target phase angle θtw to decide whether or not θtp≦θtw (step S905).

When it is determined in the step S905 that θtp≦θtw (i.e., "YES"), the ultimate target phase angle θt is replaced by change over or set to the lock-pin-release-limited target phase angle θtp (step S906), whereas when it is determined in the step S905 that θtp>θtw (i.e., "NO"), the ultimate target phase angle θt is set to the water-temperature-limited target phase angle θtw (step S907).

Finally, the time period (e.g. 25 [msec]) taken for the processing shown in FIG. 9 is added to the counter value of the target limit counter CT after the lock pin has been released (step S908), whereupon the processing routine shown in FIG. 9 comes to an end [Return].

In this manner, the presence or absence of the torque demand at the time of starting the lock pin release control is estimated on the basis of the torque demand flag xtq, and the change rate β of the target phase angle is altered or modified in dependence on whether or not the torque demand has been issued.

More specifically, when the torque demand is absent (i.e., when xtq="0"), the change rate β2 which is smaller than β1 for the case where the torque demand has been issued is validated to thereby suppress the change of the target phase angle θt after detection of release of the lock pin. In this manner, occurrence of shock unexpectedly to the driver in the state where no torque demand is issued can positively be suppressed or prevented.

On the other hand, when the torque demand has been issued (i.e., when xtq="1"), the change rate β1 greater than β2 for the case where no torque demand has been issued is validated to thereby allow the target phase angle θt to speedily approach the base target phase angle θmap. In this way, delay in the response of the detected phase angle θa which would otherwise be brought about by to execution of the lock pin release control can be suppressed to a minimum.

Now, referring to FIGS. 10 and 11, description will be made in more detail of the processing procedure according to the first embodiment of the invention.

FIG. 10 is a timing chart for graphically illustrating a change of the detected phase angle (θa) as a function of time in the case where absence of the torque demand is estimated at the time point when the execution request for the lock pin release control has been issued.

Referring to FIG. 10, from the time point tps at which the target phase angle θtw exceeds the predetermined angle of e.g. 5 [deg. CA]), the control for unlocking the lock pin 15 is started, as described hereinbefore by reference to FIG. 28.

At this time point tps, the reflection factor α is smaller than "1.0" (see the bottom row in FIG. 10). Thus, the target phase angle limit flag xlim remains "1" (see the middle row in FIG. 10).

Further, at this time point tps, the lock pin release counter CP is cleared to "0 (zero)" in the step S105 shown in FIG. 1 while the torque demand flag xtq is set to "0" in the step S703 shown in FIG. 7.

Further, the change rate β of the ultimate target phase angle θt is set to the second value β2 which is smaller than the first value β1 in the step S903 shown in FIG. 9.

Accordingly, the ultimate target phase angle θt (see the broken line segment shown at the top row in FIG. 10) gradually increases more slowly than the detected phase angle θa in the conventional apparatus (see FIG. 28) from the time point tpe at which the released state of the lock pin 15 is detected in succession to the above-mentioned time point tps, to converge on the base target phase angle θmap.

As a result of this, the change rate of the detected phase angle θa in the apparatus according to the instant embodiment of the invention is sufficiently suppressed when compared with the detected phase angle θa in the conventional apparatus described hereinbefore (see FIG. 28) even when the phase feedback control is executed from the time point tpe at which the unlocked state is detected, as can be seen in FIG. 10.

By way of example, let's assume that the valve timing control inhibit state is cleared due to the rise of the cooling water temperature thw in the course of steady operation (cruising) of the motor vehicle with the depression of the accelerator pedal (and hence the throttle opening degree) being held constant. In that case, no torque demand is issued at the time point when the execution request for the lock pin release control is issued.

Incidentally, the driver is ordinarily unconscious of clearing of the valve timing control from inhibition.

In that case, by suppressing the valve timing change rate by setting the change rate β to the small value β2 to thereby cause the ultimate target phase angle θt to approach slowly the base target phase angle θmap, the driver of the motor vehicle can positively be protected against shock brought about by the torque fluctuation. In this manner, occurrence of shock unexpected by the driver can be suppressed or prevented with high reliability.

FIG. 11 is a timing chart for graphically illustrating behavior of the detected phase angle ea when it is estimated that the torque demand is present at the time point when the execution request for the lock pin release control is issued on the presumption that limitation by the cooling water temperature thw has already been cleared, i.e., the reflection factor a of the base target phase angle θmap is "1".

Referring to FIG. 11, the lock pin release control is started from the time point tps at which the water-temperature-limited target phase angle etw has exceeded 5 [deg. CA].

In that case, the cam phase advancing command has been issued in response to the request of the driver. Accordingly, it is desirable to control the valve timing so as to conform with the base target phase angle θmap as speedily as possible after the lock pin 15 has been released from the locked state.

In the case illustrated in FIG. 11, the reflection factor α is already "1.0" at the time point tps when the water-temperature-limited target phase angle θtw has exceeded the predetermined angle. Accordingly, the value of the target phase angle limit flag xlim is "0" at this time point.

Further, at this time point tps, the value of the lock pin release counter CP is "0", and the torque demand flag xtq is set to 1" in the step S704 shown in FIG. 7.

In addition, the change rate β of the ultimate target phase angle θt is set to the first value β1 which is greater than β2.

Consequently, the ultimate target phase angle θt increases steeply from the time point tpe at which the released state of the lock pin 15 is detected, to converge rapidly on the base target phase angle θmap. Thus, by carrying out the phase feedback control from the above-mentioned time point tpe, it is possible to cause the detected phase angle θa to follow the base target phase angle θmap more speedily than the case shown in FIG. 10.

At this time point, shock may take place due to the steep change of the valve timing advance quantity (large change rate β1). However, since this shock is considerably smaller than the shock which occurs due to change of the engine operation state brought about intentionally by the driver (e.g. increasing of depression of the accelerator pedal). Accordingly, the driver will scarcely feel uncomfortableness, (incurring essentially no problem).

More specifically, the presence or absence of the torque demand at the time point when the execution request for the lock pin release control is issued is estimated on the basis of the limited state of the base target phase angle θmap determined by the engine operation state, whereon the control quantity for the ultimate target phase angle θt used in the phase feedback control is changed correspondingly. Thus, the change rate of the ultimate target phase angle θt can be suppressed so long as the depression of the accelerator pedal (i.e., throttle opening degree) remains constant (cruising operation).

In this manner, the change of the valve timing can be suppressed and thus the shock which may be brought about by the change of torque can be excluded from the driver. Thus, occurrence of the shock unexpected by the driver can be suppressed positively through the relatively simple processing procedure.

Further, in the case where the torque demand is intentionally issued by the driver (e.g., by depressing the accelerator pedal), the valve timing can be caused to speedily follow the base target phase angle θmap by loosening the limitation imposed on the change rate of the ultimate target phase angle θt.

In this way, when the torque demand is issued, delay in the valve timing control response upon execution of the lock pin release control can be suppressed to a minimum while ensuring release of the lock pin 15 from the locked state without fail through relatively simple processing procedure. Thus, the engine performance such as the output torque, exhaust gas quality and others can effectively be improved.

Embodiment 2

In the valve timing control apparatus according to the first embodiment of the present invention, the target phase angle limit flag (limited state) xlim of the base target phase angle θmap is used as the an indicator of torque demand at the time point tps when the execution request for the lock pin release control is issued. In the valve timing control apparatus according to a second embodiment of the invention, the torque demand at the above-mentioned time point tps is estimated on the basis of the change rate or quantity of the throttle opening degree.

In the following, referring to FIGS. 12 to 16, description will be directed to the valve timing control apparatus according to the second embodiment of the invention in which the torque demand is estimated on the basis of the change quantity of the throttle opening degree.

In the description which follows, it is presumed that the relative angle of the cam shaft relative to the crank shaft (valve timing) is controlled, as in the case of the embodiment described hereinbefore. Thus, it is also presumed that the oil passage arrangement is such that the lock pin 15 can be released from the locked state only with the hydraulic pressure effective for advancing the valve timing and that the retaining hole 18 for the lock pin 15 is disposed at the most retard position.

Figure 12:
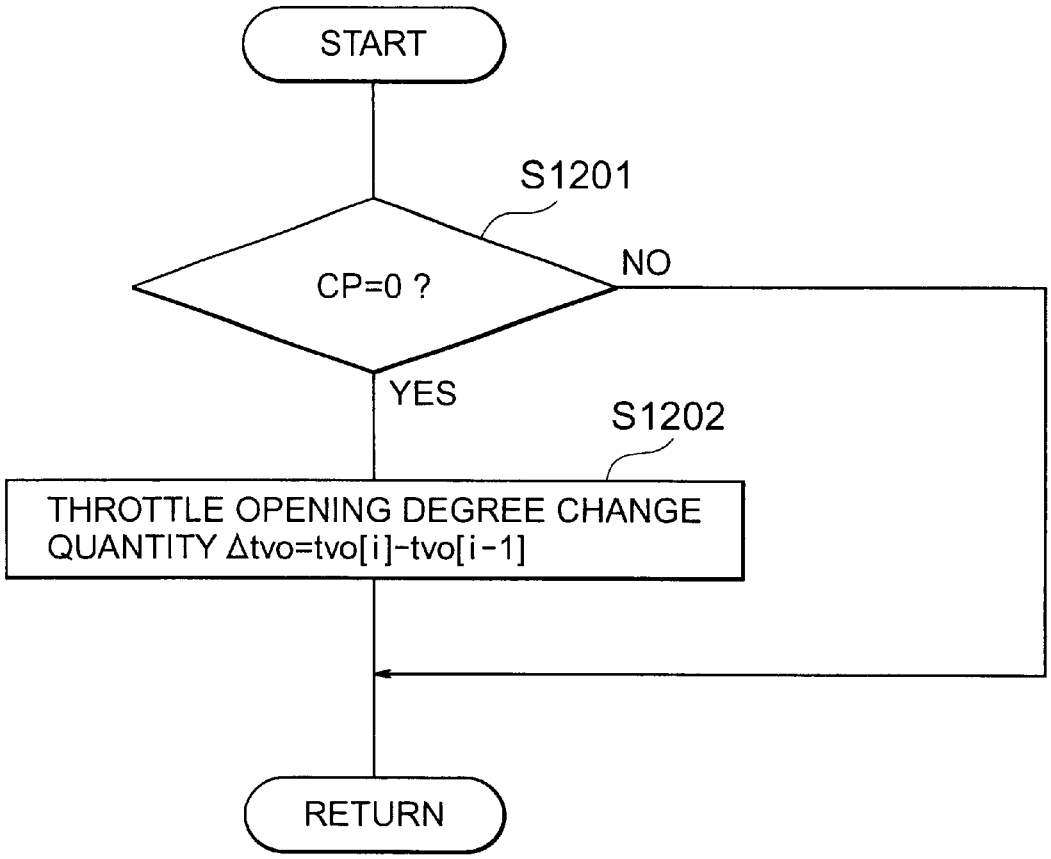
FIG. 12 is a flowchart showing a processing procedure for determining a change quantity of a throttle opening degree in a valve timing control apparatus according to a second embodiment of the present invention.
Figure 13:
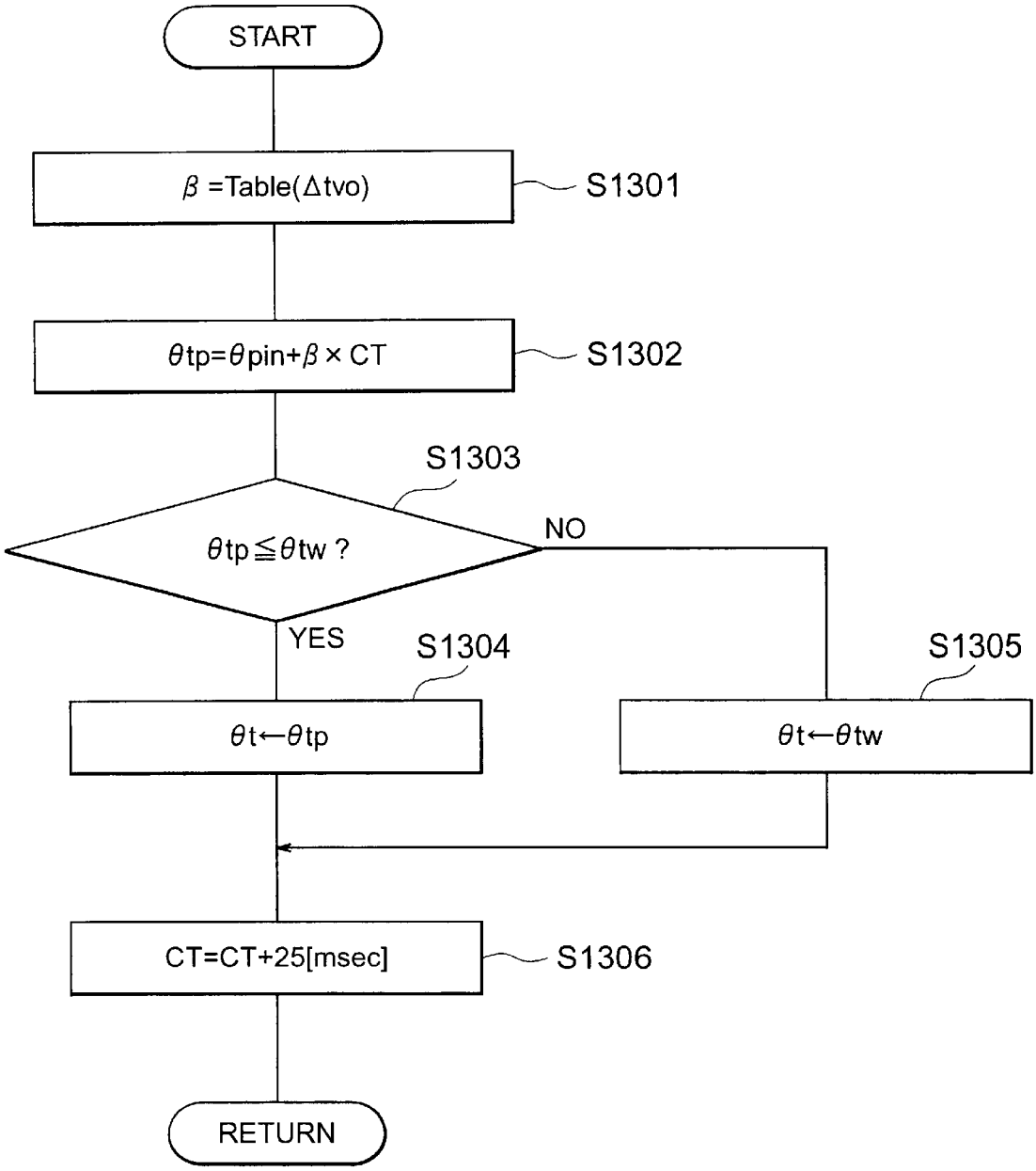
FIG. 13 is a flow chart showing a processing procedure for arithmetically determining an ultimate target phase angle on the basis of the change quantity of the throttle opening degree in the apparatus according to the second embodiment of the invention.
Figure 15:
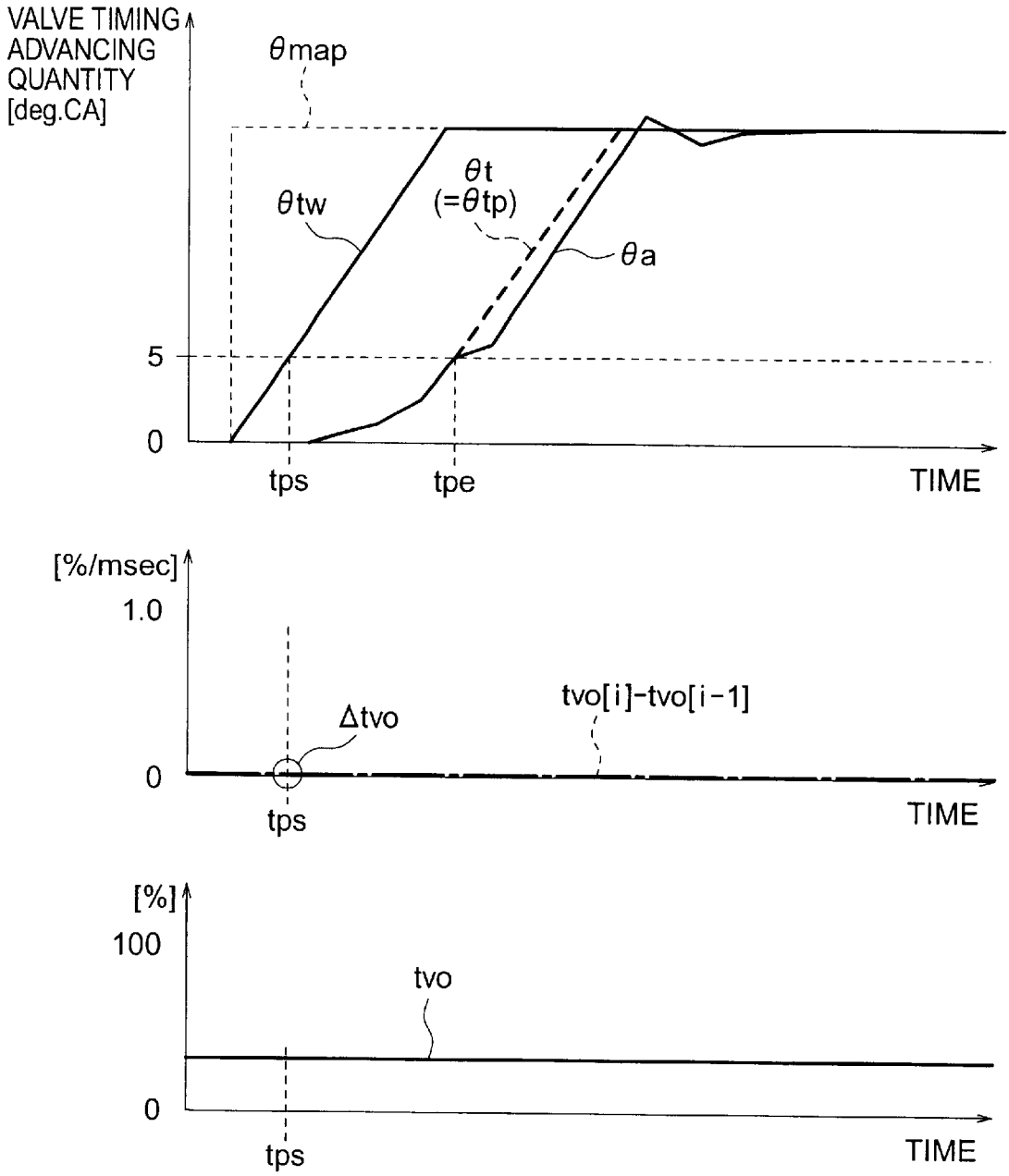
FIG. 15 is a timing chart for graphically illustrating behavior of detected phase angle when absence of torque demand is determined at a time point an execute request for lock pin release control is issued in the apparatus according to the second embodiment of the invention.
Figure 16:
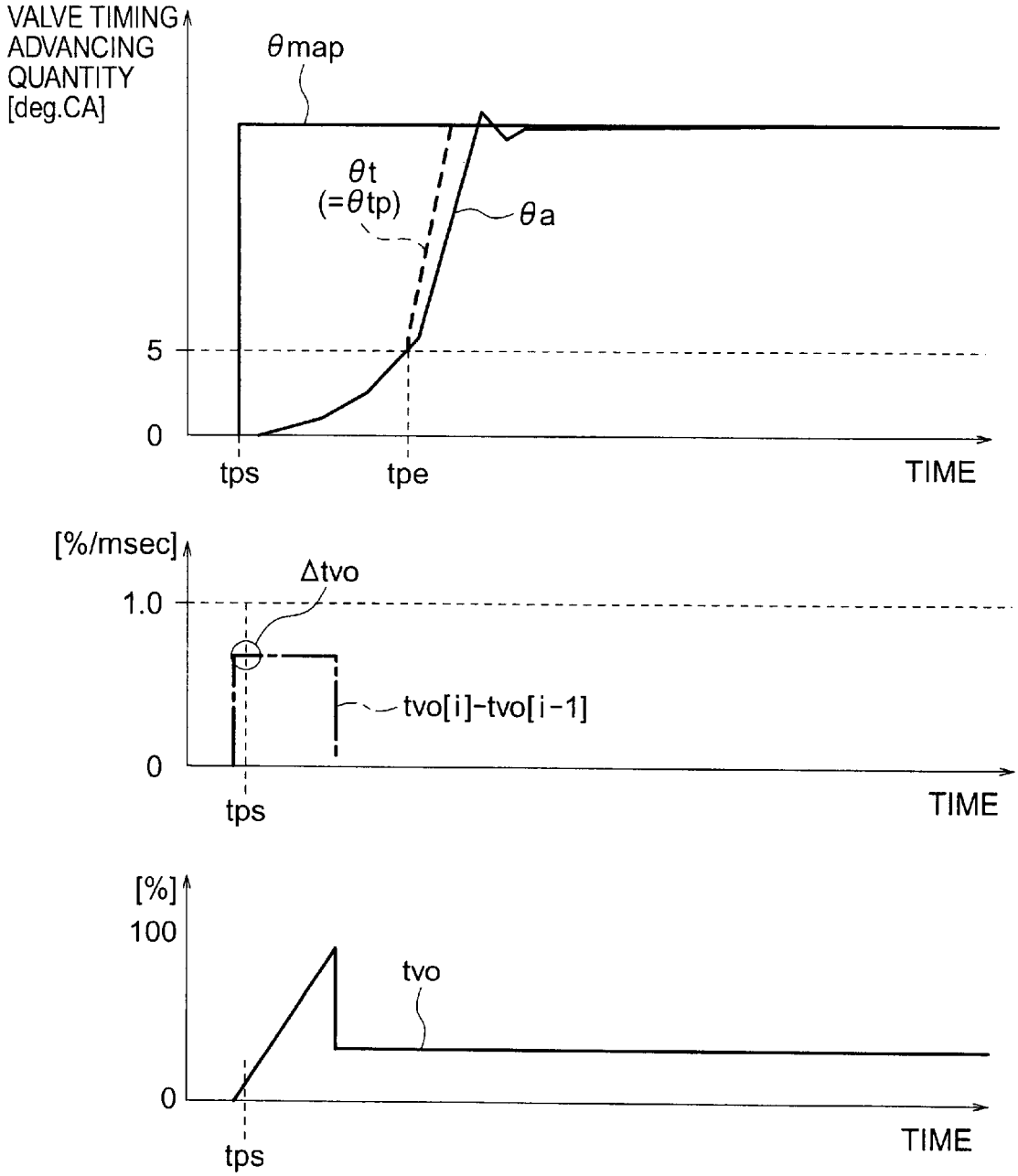
FIG. 16 is a timing chart for graphically illustrating behavior of detected phase angle when presence of torque demand is determined at a time point an execute request for lock pin release control is issued in the apparatus according to the second embodiment of the invention.

FIGS. 12 and 13 are flow charts for illustrating processings executed by the ECU incorporated in the valve timing control apparatus according to the second embodiment of the invention, FIG. 14 is a view showing a two-dimensional table of the change rate β, and FIGS. 15 and 16 are timing charts for graphically illustrating processing operations executed in the valve timing control apparatus according to the second embodiment of the invention.

More specifically, FIG. 12 shows a processing routine for determining a change rate or quantity Δtvo of the throttle opening degree.

Referring to FIG. 12, decision is firstly made in a step S1201 whether or not the lock pin release counter CP is "0". When it is determined in the step S1201 that CP>0 (i.e., "NO"), the routine shown in FIG. 12 is terminated without executing any other processing.

On the other hand, when it is determined in the step S1201 that CP="0" (i.e., "YES"), the change quantity Δtvo is computed in accordance with the undermentioned expression (4) (step S1202):

$$\Delta tvo = tvo[i] - tvo[i-1] \tag{4}$$

where tvo[i] represents the throttle opening degree in the current processing routine and tvo[i−1] represents the throttle opening degree in the immediately preceding processing.

As can be seen from the above expression (4), in the steady operation state where the throttle opening degree is held constant, the change quantity Δtvo assumes an extremely small value, whereas the change quantity Δtvo assumes a great value when the throttle valve is rapidly opened, e.g. upon acceleration of the motor vehicle.

FIG. 13 shows a processing routine for computing the ultimate target phase angle θt on the basis of the change rate Δtvo of the throttle opening degree. Incidentally, steps S1303 to S1306 whown in FIG. 13 are same as the steps S905 to S908 described hereinbefore by reference to FIG. 9. Accordingly, repeated description of these steps will be unnecessary.

Referring to FIG. 13, the change rate β of the lock-pin-release-limited target phase angle θtp is computed in accordance with the undermentioned expression (5)(in a step S1301.

$$\beta = \mathrm{Table}(\Delta tvo) \tag{5}$$

In the above expression (5), Table (Δtvo) represents a function for determining the value of the change quantity Δtvo of the throttle opening degree by referencing the two-dimensional table shown in FIG. 14.

In succession, the lock-pin-release-limited target phase angle θtp is computed in accordance with the following expression (6) in a step S1302.

$$\theta tp = \theta pin + \beta \times CT \tag{6}$$

Subsequently the processing steps S1303 to S1306 which are similar to the steps S905 to S908 described previously are executed, whereon the processing routine whown in FIG. 13 is terminated.

At this juncture, it should be added that the change rate β of the ultimate target phase angle θt set in the step S1301 assumes a large value when the change quantity Δtvo of the throttle opening degree in large (i.e., in case the torque demand is of large value).

As is apparent from the above, the state in which the change quantity Δtvo of the throttle opening degree is large corresponds to, for example, the state in which the accelerator pedal is depressed by the driver for opening speedily the throttle valve with the intention for accelerating the motor vehicle.

In that case, the ultimate target phase angle θt approaches rapidly to the base target phase angle θmap immediately after the lock pin release has been detected. Thus, the valve timing can swiftly follow the base target phase angle θmap.

On the other hand, in the case where the change quantity Δtvo of the throttle opening degree is "0" or a very small value (indicating absence of the torque demand) in the steady operation state, the change rate of the ultimate target phase angle θt is set to a small value, whereby the quantity of change to the ultimate target phase angle θt immediately after the detection of the lock pin release (i.e., change quantity of the valve timing) can be made small.

Thus, in the steady operation, no rapid change of the valve timing can occur. Thus, occurrence of the shock unexpected by the driver can be suppressed with high reliability.

Next, referring to the timing charts shown in FIGS. 15 and 16, elucidation will be made of the processing operations mentioned above.

Parenthetically, FIGS. 15 and 16 correspond to FIGS. 10 and 11 (processings executed in the steady operation state and upon depression of the accelerator pedal, respectively) described previously.

More specifically, FIG. 15 is a timing chart for graphically illustrating behavior of the detected phase angle θa as a function of time in the case where it is estimated that no torque demand has been issued at the time point tps when the execution request for the lock pin release control is issued.

Referring to FIG. 15, the lock pin release control is started from the time point tps at which the water-temperature-limited target phase angle θtw exceeds 5[deg. CA]. At this time point tpo, the lock pin release counter CP is "0". Accordingly, the change quantity Δtvo of the throttle opening degree is computed in accordance with the expression (4) mentioned hereinbefore (step S1202 in FIG. 12).

However, since the throttle opening degree tvo is constant (Δtvo="0") up to the aforementioned time point tps, computation of the change rate β in accordance with the expression (5) mentioned hereinbefore (step S1301 in FIG. 13) by referencing the two-dimensional table whown in FIG. 14 will result in that the change rate β is set to a minimum value.

consequently, the ultimate target phase angle θt (see the broken line segment shown at the top row in FIG. 15) gradually increases slowly from the time point tpe at which the released state of the lock pin 15 is detected, to converge on the base target phase angle θmap.

Figure 28:
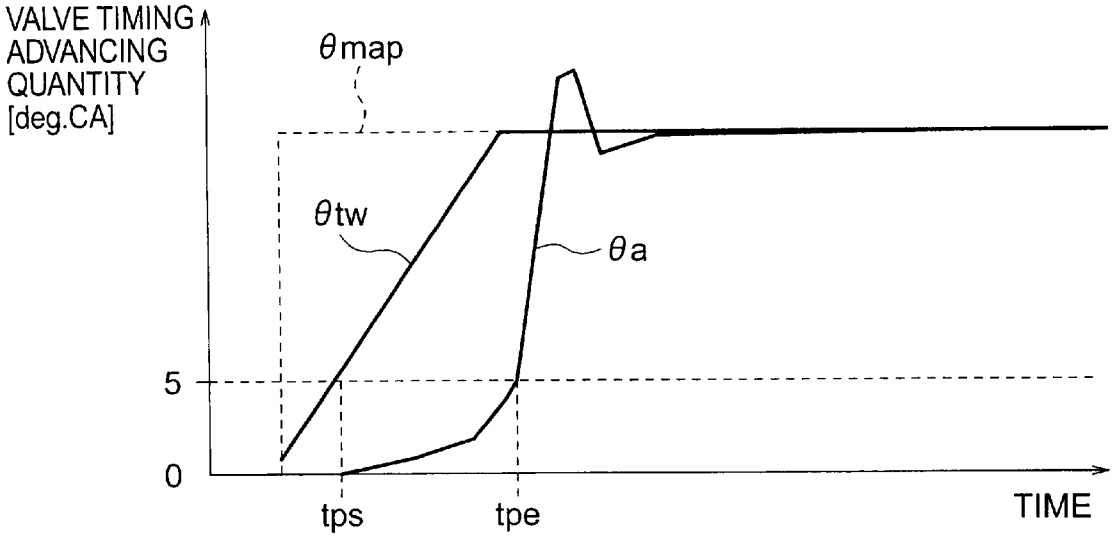
FIG. 28 is a timing chart for graphically illustrating behavior of the detected phase angle in the conventional valve timing control apparatus.

As a result of this, when the phase feedback control is executed from the time point tpe at which the unlocked state is detected, the change quantity of the detected phase angle θa (see the solid line segment shown at the top row in FIG. 15) is suppressed when compared with that of the detected phase angle ea in the conventional apparatus described hereinbefore by reference to FIG. 28.

By way of example, let's assume that the valve timing control inhibited state is cleared due to the rise of the cooling water temperature thw in the course of steady operation of the motor vehicle with the depression of the accelerator pedal (throttle opening degree) being held constant). In that case, no torque demand has been issued at the time point when the execution request for the lock pin release control is issued. Further, the driver is ordinarily unconscious of releasing of the valve timing control from the inhibited state.

In that case, the change quantity of the valve timing can be suppressed to a small value by setting the change rate to a sufficiently small value so that the ultimate target phase angle can slowly approach the base target phase angle, whereby the driver of the motor vehicle can positively be protected against shock due to fluctuation of torque. In this manner, occurrence of shock unexpectedly for the driver can be prevented with high reliability.

FIG. 16 is a timing chart for graphically illustrating behavior of the detected phase angle θa when it is estimated that the torque demand has been issued at the time point tps when the execution request for the lock pin release control is issued.

Referring to FIG. 16, the lock pin release control is started from the time point tps at which the water-temperature-limited target phase angle θtw (see FIG. 15) has exceeded 5 [deg. CA] (see FIG. 15), as described previously.

In this case, the accelerator pedal is depressed by the driver at the time point tps. Accordingly, the change quantity Δtvo of the throttle opening degree assumes a large value when compared with that described previously in conjunction with FIG. 15.

Accordingly, when the change rate β of the ultimate target phase angle θt is arithmetically determined by referencing the two-dimensional table shown in FIG. 14 (step S1301 in FIG. 13), the change rate β mentioned above is set to a greater value when compared with the change rate β described previously in conjunction with FIG. 15. Consequently, the ultimate target phase angle Et will increase steeply from the time point tpe at which the released state of the lock pin 15 is detected, to converge rapidly on the base target phase angle θmap.

As a result of this, when the phase feedback control is executed from the aforementioned time point tpe, the detected phase angle θa follows the base target phase angle θmap more speedily when compared with the case described previously by reference to FIG. 15.

In the case illustrated in FIG. 16, shock will take place due to the rapid change of the valve timing. However, this shock is considerably smaller than the shock which occurs due to change of the operation state (intended by the driver). Accordingly, the driver will scarcely feel uncomfortableness, presenting no problem.

Furthermore, since the valve timing follows rapidly the base target phase angle θmap in the case illustrated in FIG. 16, delay in the valve timing control response due to execution of the lock pin release control can be suppressed to minimum.

In this manner, by estimating the torque demand at the time point when the execution request for the lock pin release control is issued on the basis of the change quantity Δtvo of the throttle opening degree in which the intention of the driver is directly reflected and by altering the degree of limitation imposed on the ultimate target phase angle θt used in the phase feedback control, it is possible to estimate the torque demand for the engine 101 with high accuracy.

By adjusting the change quantity of the ultimate target phase angle et by making use of the torque demand estimated with high accuracy as mentioned above, it is possible to adjust or regulate the change quantity of the valve timing with an enhanced degree of freedom.

As a result of this, occurrence of shock unexpected for the driver can be suppressed while ensuring the release of the lock pin 15 without fail. Thus, the engine performance such as output torque, exhaust gas quality and others can be improved to a possible maximum.

Embodiment 3

In the valve timing control apparatus according to the second embodiment of the invention, the torque demand at the time point tps is estimated on the basis of the change quantity Δtvo of the throttle opening degree. In the valve timing control apparatus according to a third embodiment of the present invention, a change of a parameter indicating the flow rate of the intake air fed to the engine 101 is utilized for estimation of the torque demand.

In the following, referring to FIGS. 17 to 21, description will be made of the valve timing control apparatus for the engine according to the third embodiment of the invention in which the torque demand is estimated on the basis of the change quantity of the parameter indicating the intake air flow.

Figure 20:
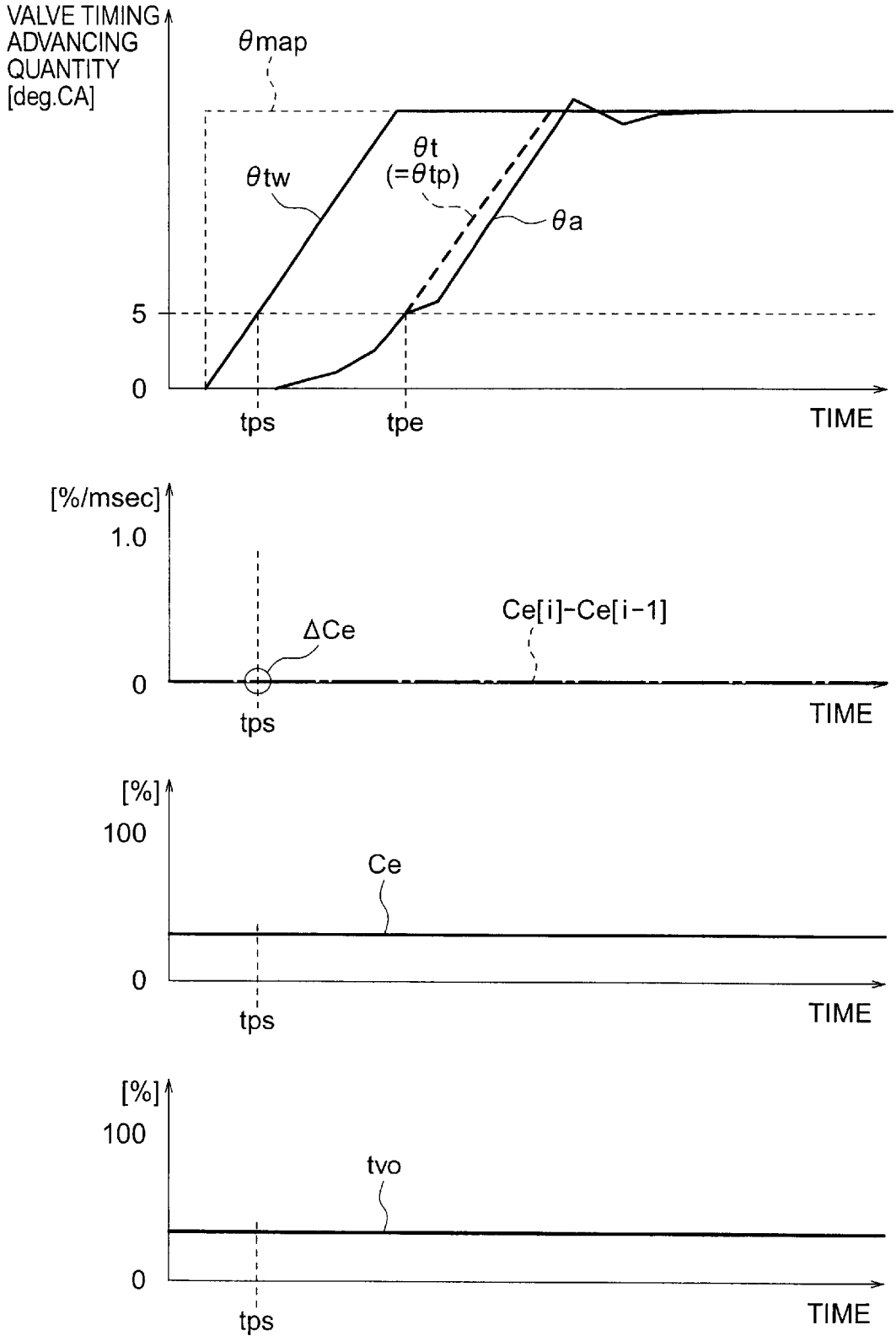
FIG. 20 is a timing chart for graphically illustrating behavior of detected phase angle when absence of torque demand is determined at a time point an execute request for lock pin release control is issued in the apparatus according to the third embodiment of the invention.
Figure 21:
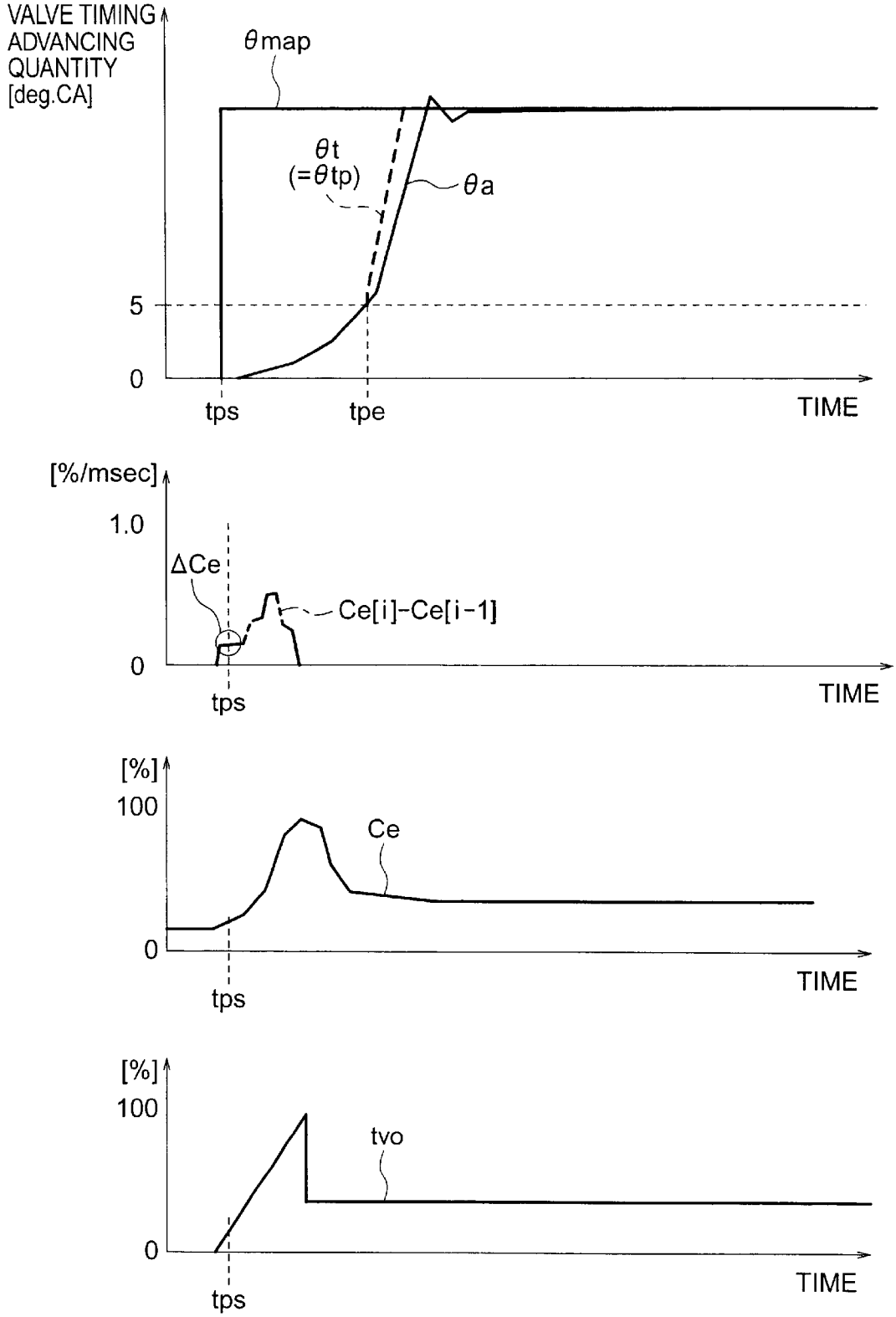
FIG. 21 is a timing chart for graphically illustrating behavior of detected phase angle when presence of torque demand is determined at a time point an execute request for lock pin release control is issued in the apparatus according to the third embodiment of the invention.
Figure 22:
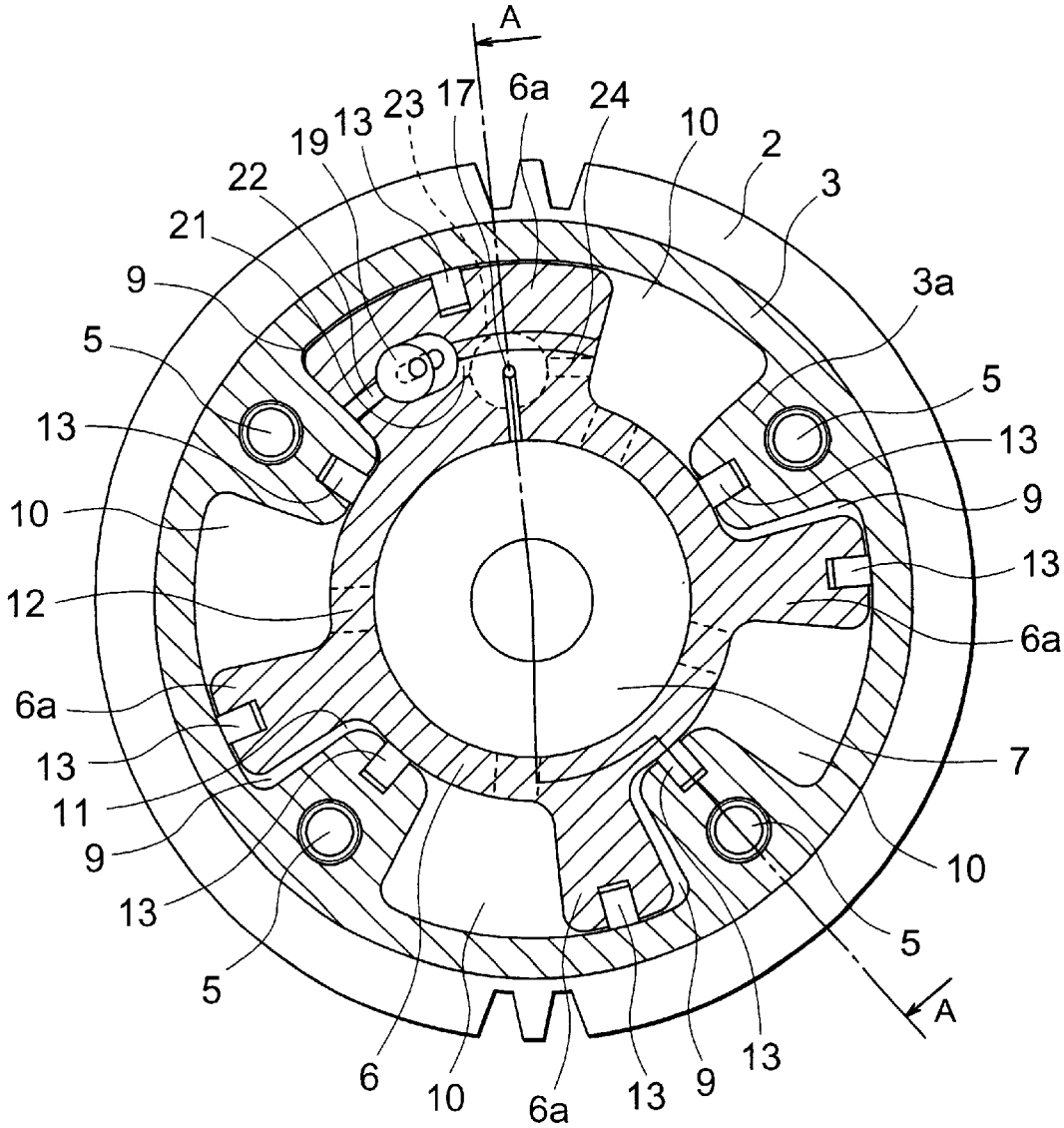
FIG. 22 is a sectional view showing an internal structure of a conventional vane-type valve timing regulating apparatus to which the present invention can find application.
Figure 23:
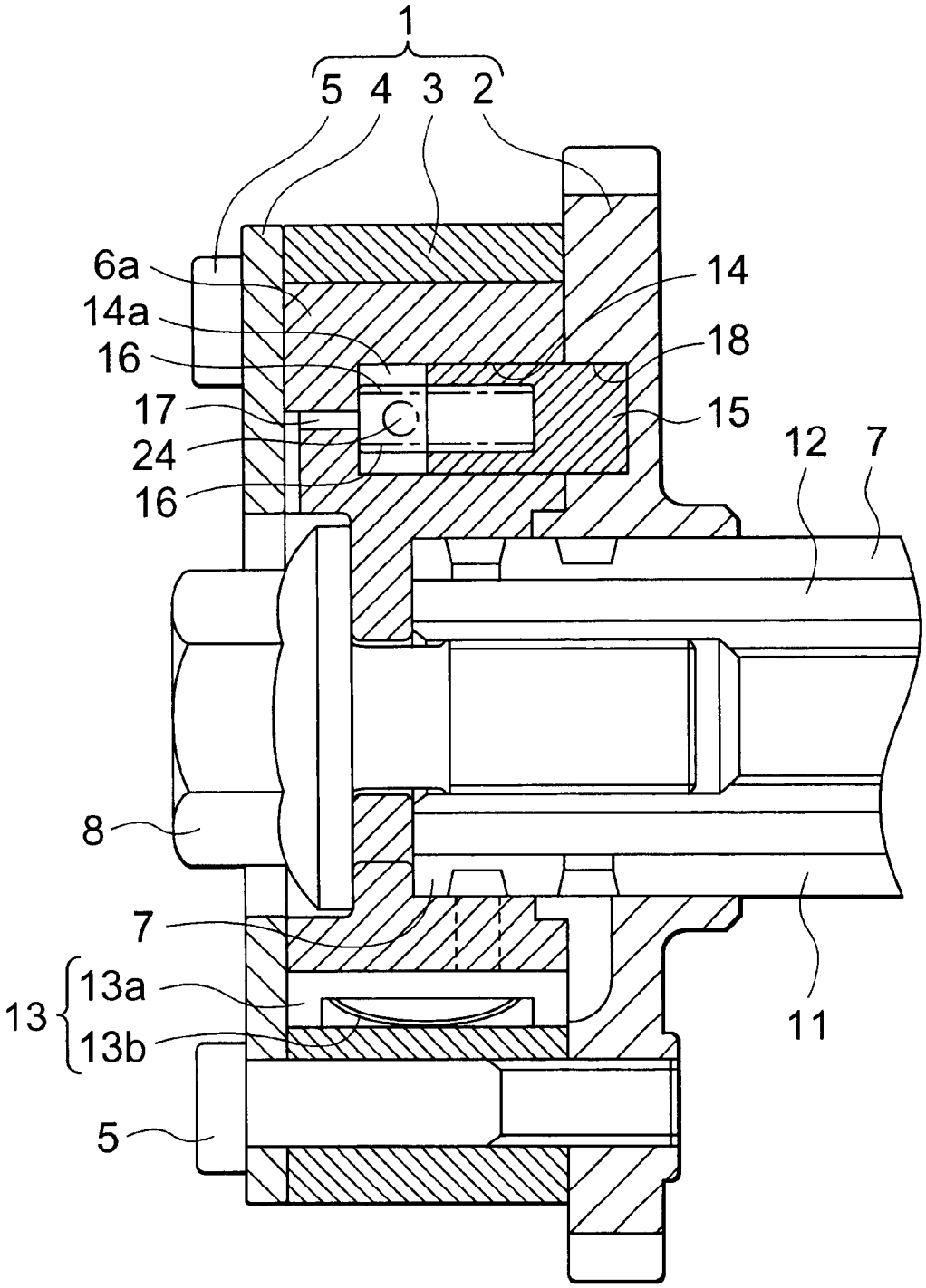
FIG. 23 is a vertical sectional view of the same taken along a line A—A in FIG. 22.
Figure 24:
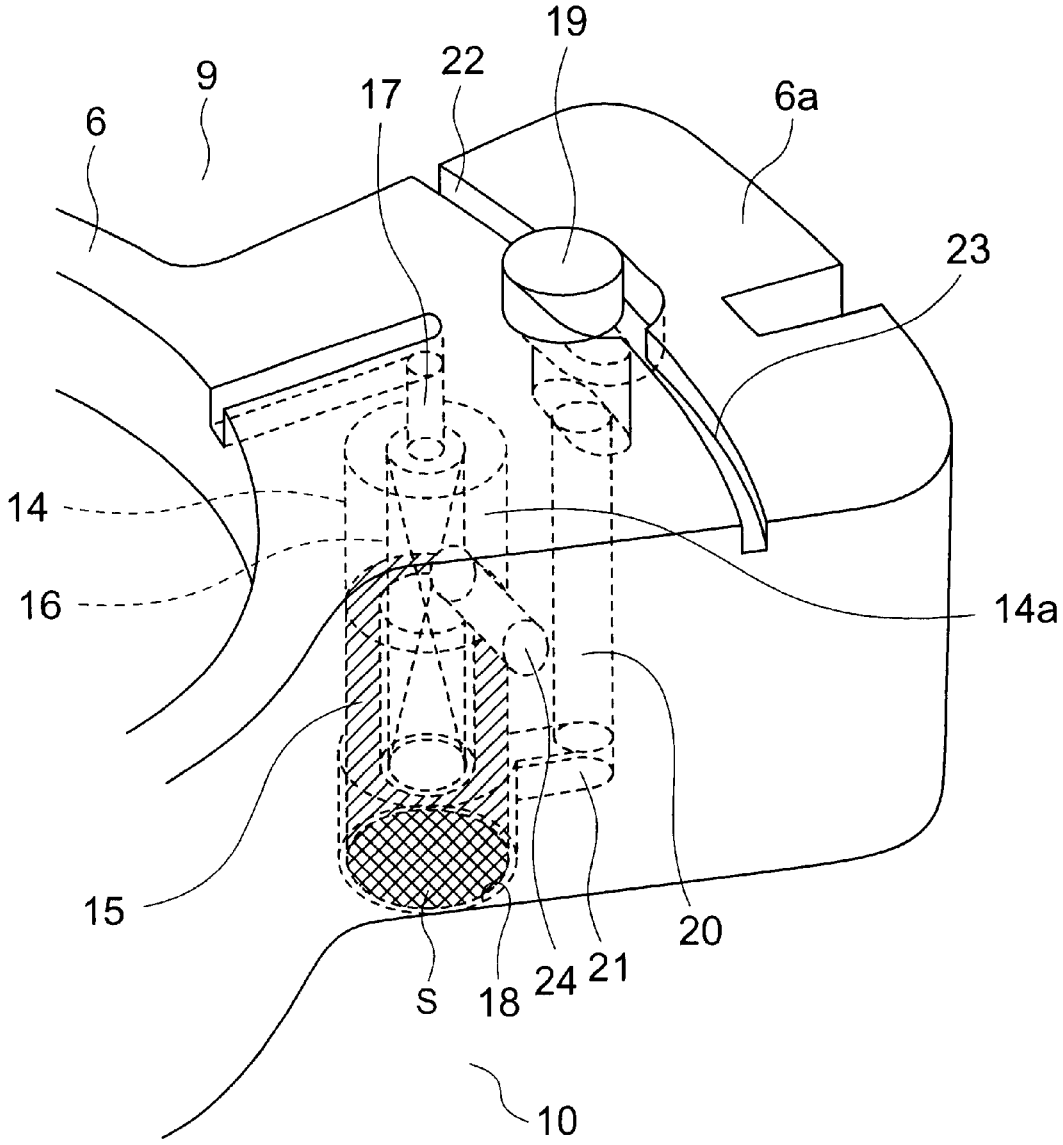
FIG. 24 is a partial perspective view showing a lock/unlock mechanism and a peripheral structure thereof in the valve timing regulating apparatus shown in FIG. 22.
Figure 25:
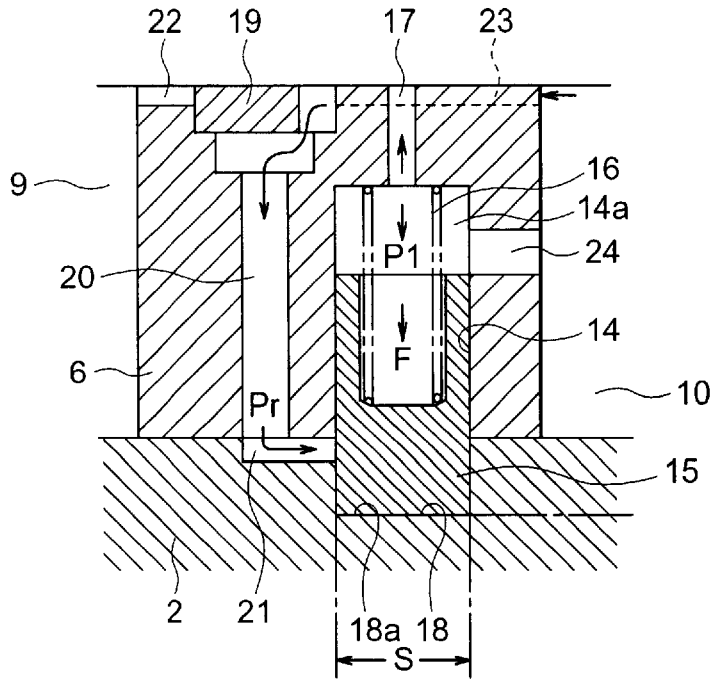
FIG. 25 is a vertical sectional view showing a major portion of the lock/unlock mechanism shown in FIG. 24.
Figure 26:
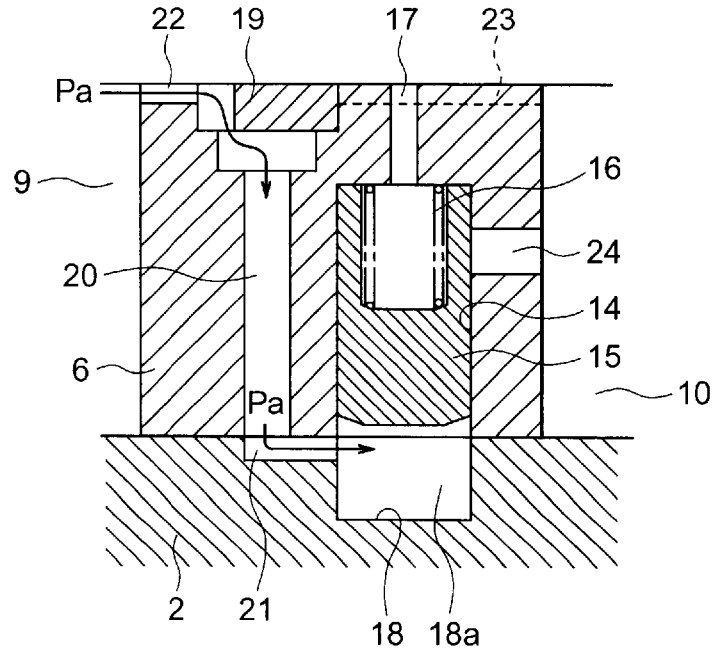
FIG. 26 is a vertical sectional view showing a major portion of the lock/unlock mechanism shown in FIG. 24.

FIGS. 17 to 21 correspond, respectively, to FIGS. 12 to 16 described previously, wherein FIGS. 17 and 18 are flow charts for illustrating processings executed in the valve timing control apparatus according to the third embodiment of the invention, FIG. 19 is a view showing a table of the change rate β, and FIGS. 20 and 21 are timing charts for graphically illustrating processing operations executed in the valve timing control apparatus according to the third embodiment of the invention.

In the valve timing control apparatus according to the instant embodiment of the invention, it is presumed that the relative angle of the cam shaft to the crank shaft (valve timing) is controlled, that the oil passage arrangement is made such that the lock pin 15 can be released from the locked state only with the hydraulic pressure effective for advancing the valve timing, and that the retaining hole 18 for the lock pin 15 is disposed at the most retard position, as in the case of the embodiments described hereinbefore.

The valve timing control apparatus according to the instant embodiment of the invention differs from the second embodiment in the respect that the torque demand at the time point when the execution request for the lock pin release control is issued is not estimated from the change quantity Δtvo of the throttle opening degree but estimated on the basis of the change quantity ΔCe of the parameter indicating the intake air flow (e.g. the charging efficiency Ce).

Figure 17:
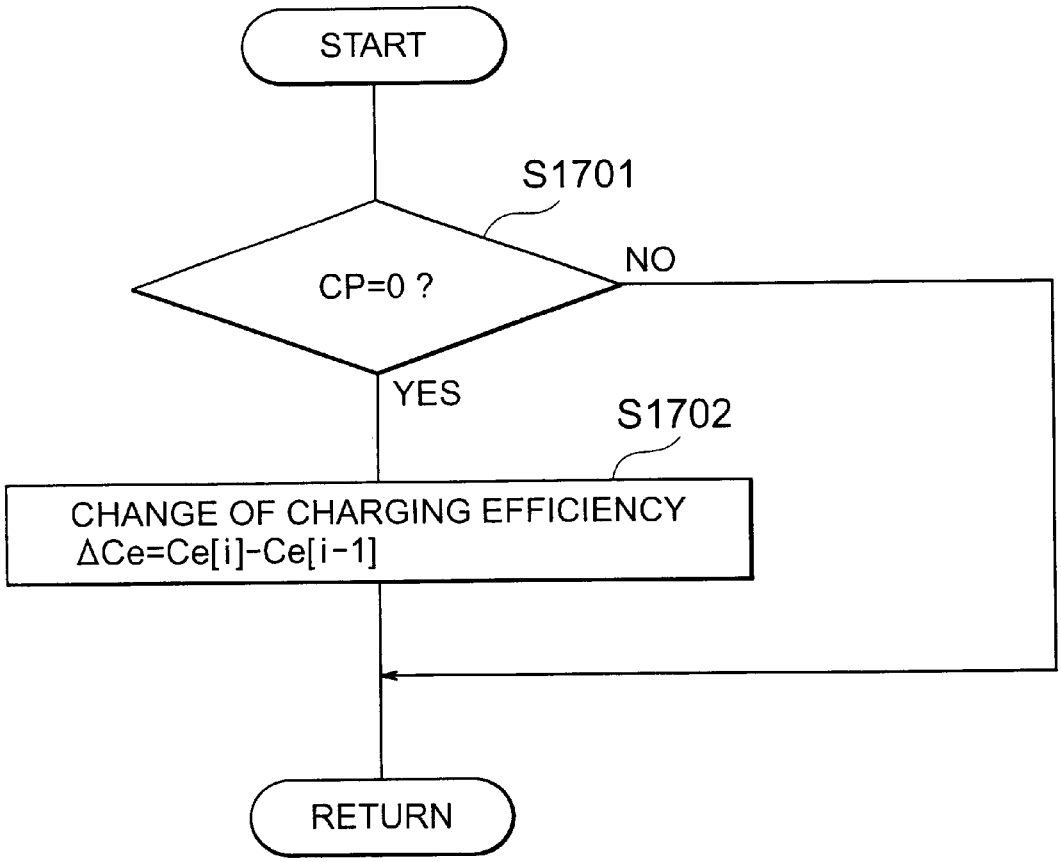
FIG. 17 is a flow chart showing a processing procedure for determining a change quantity of a charging efficiency in a valve timing control apparatus according to a third embodiment of the present invention.

FIG. 17 shows a processing routine for determining a change quantity ΔCe of the charging efficiency Ce.

Referring to FIG. 17, decision is firstly made in a step S1701 whether or not the lock pin release counter CP is "0". When it is determined in the step S1701 that CP>0 (i.e., when S1701 is "NO"), the processing routine shown in FIG. 17 is terminated straightforwardly.

On the other hand, when it is determined in the step S1701 that CP="0" (i.e., "YES"), the change quantity ΔCe of the charging efficiency Ce is computed in accordance with the undermentioned expression (7) in a step S1702, whereupon the processing routine shown in FIG. 17 comes to an end [Return].

$$\Delta Ce = Ce[i] - Ce[i-1] \tag{7}$$

where Ce[i] represents the charging efficiency in the current processing routine, and Ce[i−1] represents the charging efficiency in the immediately preceding processing routine.

As can be seen from the above expression (7), change quantity ΔCe of the charging efficiency determined through the processing shown in FIG. 17 assumes an extremely small value in the steady operation state where the charging efficiency Ce is constant, whereas the change quantity Δtvo assumes a great value when the intake air flow or quantity increases rapidly as in the case of accelerating operation.

Figure 18:
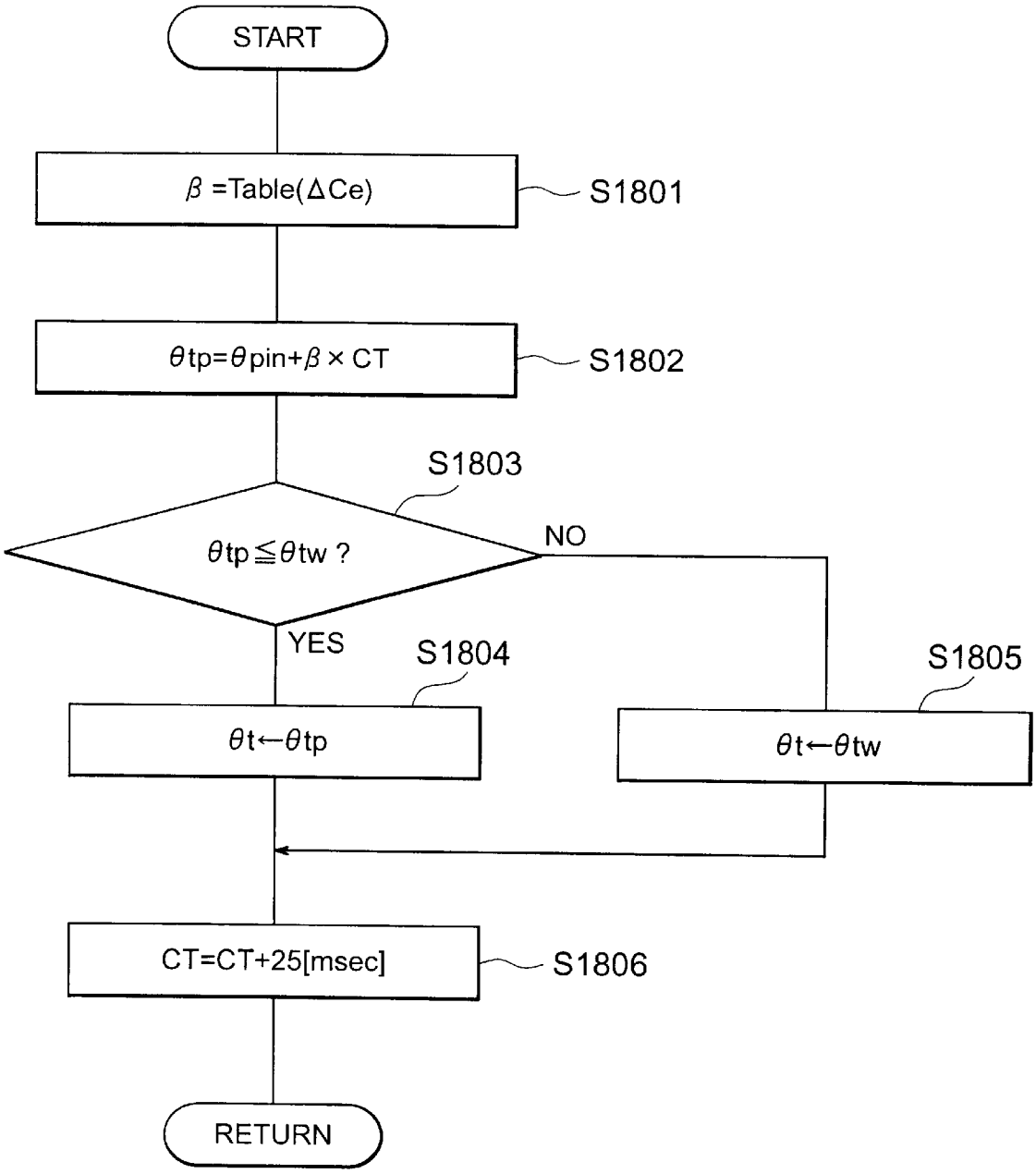
FIG. 18 is a flow chart showing a processing procedure for arithmetically determining an ultimate target phase angle on the basis of the change quantity of the charging efficiency in the apparatus according to the third embodiment of the invention.

FIG. 18 shows a processing routine for computing the ultimate target phase angle θt from the change quantity ΔCe of the charging efficiency. Incidentally, steps S1801 and S1802 whown in FIG. 18 correspond, respectively, to the steps S1301 to S1302 described hereinbefore by reference to FIG. 13.

Furthermore, steps S1803 to S1806 shown in FIG. 18 are essentially same as the processing steps S905 to S908 described hereinbefore by reference to FIG. 9. Accordingly, repeated description of these steps will be unnecessary.

Referring to FIG. 18, the change rate β of the lock-pin-release-limited target phase angle θtp is firstly computed in accordance with the undermentioned expression (8) in a step S1801.

$$\beta = \mathrm{Table}(\Delta Ce) \tag{8}$$

In the above expression (8), "Table (Δtvo)" represents a function for determining the value of the change Δtvo of the throttle opening degree by referencing a two-dimensional table shown in FIG. 19.

Subsequently, the lock-pin-release-limited target phase angle θtp is computed in accordance with the following expression (9) in a step S1802.

$$\theta tp = \theta pin + \beta \times CT \tag{9}$$

Subsequently, processing steps S1303 to S1306 which are similar to the steps S905 to S908 mentioned previously are executed, whereon the processing routine shown in FIG. 18 is terminated.

Incidentally, it should be added that although the change ΔCe of the charging efficiency is made use of as the parameter indicating the intake air quantity, other parameter such as change of the pressure within the intake pipe, volume efficiency or the like may equal be employed substantially to the same effect.

In this case, the change rate of the ultimate target phase angle θt (see FIG. 19) is set in the similar manner as described previously by reference to FIG. 14. Accordingly, when the driver opens rapidly the throttle valve with the aim of accelerating the motor vehicle (with the intake air quantity increasing steeply), the change rate β is set to a large value since the change quantity ΔCe is large (i.e., since the torque demand is large).

In this manner, the ultimate target phase angle θt can speedily approach to the base target phase angle θmap immediately after the detection of the release of the lock pin. Thus, the valve timing can swiftly follow the base target phase angle θmap.

On the other hand, in the case where the change quantity ΔCe of the charging efficiency Ce is "0" or a very small value (indicating the absence of the torque demand) in the steady engine operation, the change rate β of the ultimate target phase angle θt is set to a small value.

Thus, the change quantity of the ultimate target phase angle θt can be suppressed immediately after the detection of the release of the lock pin, whereby change quantity of the valve timing can be made small. By virtue of this feature, rapid change of the valve timing can positively be suppressed, whereby occurrence of shock unexpected by the driver can be prevented.

Next, referring to the timing charts shown in FIGS. 20 and 21, description will be made in detail of the processing operations mentioned above.

Parenthetically, FIGS. 20 and 21 correspond to FIGS. 15 and 16 (processings executed in the steady operation and upon depression of the accelerator pedal, respectively) described previously.

More specifically, FIG. 20 is a timing chart for graphically illustrating behavior of the detected phase angle (ea) in the case where absence of the torque demand is estimated at the time point tps when the execution request for the lock pin release control has been issued.

Referring to FIG. 20, the lock pin release control is started from the time point tps at which the water-temperature-limited target phase angle θtw exceeds 5 [deg. CA]. At this time point tpo, the value of the lock pin release counter CP is "0". Accordingly, the change quantity ΔCe of the charging efficiency is computed in accordance with the expression (7) mentioned hereinbefore (appearing in the step S1802 in FIG. 18).

However, since the throttle opening degree tvo is constant (Δtvo="0") up to the aforementioned time point tps, the charging efficiency Ce remains constant (Ce=0). Accordingly, computation of the change rate β in accordance with the expression (8) mentioned hereinbefore (step S1801 in FIG. 18) by referencing the table whown in FIG. 19 will result in that the change rate β is set to a minimum value.

Accordingly, the ultimate target phase angle θt (see the broken line segment shown at the top row in FIG. 20) gradually increases slowly from the time point tpe at which the released state of the lock pin 15 is detected, to converge on the base target phase angle θmap.

As a result of this, the change quantity of the detected phase angle θa (see the solid line segment shown at the top row in FIG. 20) is suppressed when compared with that of the detected phase angle θa in the conventional apparatus described hereinbefore (see FIG. 28) when the phase feedback control is executed from the time point tpe at which the unlocked state of the lock pin is detected. Thus, occurrence of shock unexpected by the driver can be prevented with high reliability.

FIG. 21 is a timing chart for graphically illustrating behavior of the detected phase angle θa when it is estimated that the torque demand is present at the time point tps when the execution request for the lock pin release control is issued.

In FIG. 21, it is presumed that the accelerator pedal is depressed at the time point tps at which the lock pin release control is started. In this state, the charging efficiency Ce increases. Consequently, the change quantity ΔCe of the charging efficiency assumes a large value, whereby the change rate β of the ultimate target phase angle θt is set to a greater value when compared with the case shown in FIG. 20.

As a result of this, the ultimate target phase angle θt increases steeply from the time point tpe at which the released state of the lock pin 15 is detected, to converge rapidly on the base target phase angle θmap. Thus, by carrying out the phase feedback control from the above-mentioned time point tpe, the detected phase angle θa follows the base target phase angle θmap more speedily when compared with the case shown in FIG. 20, as is indicated by a solid line segment shown in FIG. 21.

In this case, a shock will take place due to the rapid change of the valve timing. However, this shock is considerably smaller than the shock which occurs due to change of the engine operation state brought about intentionally by the driver by depressing the accelerator pedal. Accordingly, the driver will scarcely feel uncomfortableness.

Further, since the valve timing follows rapidly the base target phase angle θmap, delay in the valve timing control response upon execution of the lock pin release control can be suppressed to a minimum. Thus, releasing of the lock pin 15 can be ensured without fail with the engine performance in respect to the output torque, exhaust gas quality and others being improved to a possible maximum.

Furthermore, by estimating the torque demand at the time point when the execution request for the lock pin release control is issued on the basis of the change quantity Δtvo of the intake air flow rate which contributes straightforwardly to the torque generation of the engine 101 and by altering or modifying the degree of limitation imposed on the ultimate target phase angle θt used in the phase feedback control, change of the valve timing can be regulated with a high degree of freedom. Thus, occurrence of shock unexpected by the driver can be avoided with high reliability while allowing the engine performance in respect to the output torque, exhaust gas quality and others to be improved very significantly.

The embodiments of the invention described above concern the limitation of the ultimate target phase angle θt relative to the base target phase angle θmap with the cooling water temperature thw being used as the parameter indicating the operation state of the internal combustion engine. However, it goes without saying that even when the parameter other than the cooling water temperature thw is employed for limiting the ultimate target phase angle θt, similar actions and effects can equally be realized by resorting to the processing procedures similar to those described hereinbefore.

Further, although it has been presumed in the foregoing description that the operation state of the internal combustion engine is used as the condition for limiting the ultimate target phase angle θt, it will be self-explanatory that the states of the valve timing control apparatus can also be utilized to this end.

By way of example, in the case where the various control parameters (such as, for example, learned values of the most retard position of the valve timing and others) have not been calibrated yet, the valve timing control will be inhibited as the case maybe. Even in that case, the processing procedures disclosed herein may be executed to ensure the similar advantageous actions and effects.

EFFECTS OF THE INVENTION

As is apparent from the foregoing, the present invention has provided the valve timing control apparatus for an internal combustion engine, which apparatus includes the cam shaft rotatable in synchronism with rotation of the crank shaft of the internal combustion engine for thereby setting valve timing for at least one of the intake valve and the exhaust valve of the engine, the cam phase actuator having the valve timing advancing hydraulic chambers and the valve timing retarding hydraulic chambers to which a hydraulic pressure is fed for changing the relative angle of the cam shaft to the crank shaft in the valve timing advancing direction or alternatively in the valve timing retarding direction, the locking mechanism provided in association with the cam phase actuator for locking the relative angle at the predetermined relative angle, the oil pump for generating the hydraulic pressure, the hydraulic pressure regulating means for feeding the hydraulic pressure to the valve timing advancing hydraulic chambers or alternatively to the valve timing retarding hydraulic chambers, and the engine control unit for controlling the hydraulic pressure regulating means. The locking mechanism is released under the effect of the hydraulic pressure fed to either the valve timing advancing hydraulic chambers or the valve timing retarding hydraulic chambers of the cam phase actuator upon changing of the relative angle, wherein when the relative angle is to be changed from the locked state validated by the locking mechanism, the phase feedback control of the relative angle is performed after having executed the control for releasing the locked state in advance. The engine control unit includes the change quantity limiting means for limiting a change quantity of the valve timing. This change quantity limiting means is designed to limit the change quantity of the valve timing to the predetermined value upon transition of the locked state releasing control to the phase feedback control.

By virtue of the arrangement of the valve timing control apparatus described above, there can be realized the valve timing control apparatus for the engine, which apparatus is capable of suppressing positively occurrence of the shock unexpected by the driver upon transition to the phase feedback control, even in the case where there is employed the cam phase actuator which requires operation for releasing the lock pin from the locked state in advance upon changing of the valve timing.

In the valve timing control apparatus described above, the change quantity limiting means can be so designed as to limit the change quantity of the target phase angle of the cam shaft relative to the crank shaft.

With the arrangement described above, there can be realized the valve timing control apparatus for the engine, which apparatus can suppress occurrence of the shock unexpected by the driver upon transition to the phase feedback control, even when the cam phase actuator requiring operation for releasing the lock pin from the locked state in advance upon changing of the valve timing is employed.

Further, in the valve timing control apparatus described above, the change quantity limiting means can be so designed as to estimate the torque demand existing at the time point when the control for releasing the locked state is started, to thereby modify correspondingly the degree of limitation for the change quantity of the target phase angle.

With the arrangement described above, there can be realized the valve timing control apparatus for the engine, which apparatus can suppress occurrence of the shock unexpected by the driver upon transition to the phase feedback control through a relatively simple processing procedure, even when the cam phase actuator requiring operation for releasing the lock pin from the locked state in advance upon changing of the valve timing is employed.

Furthermore, in the valve timing control apparatus described above, the change quantity limiting means can be so designed as to estimate the torque demand on the basis of the target phase angle.

With the arrangement described above, there can be realized for the engine the apparatus which can positively suppress occurrence of the shock unexpected by the driver upon transition to the phase feedback control, even in the case where the cam phase actuator requiring operation for releasing the lock pin from the locked state in advance upon changing of the valve timing is employed.

Furthermore, in the valve timing control apparatus described above, the valve timing control apparatus may further include the throttle opening degree detecting means for detecting the throttle opening degree of the internal combustion engine. In that case, the limiting means can be so designed as to estimate the torque demand on the basis of the throttle opening degree in which intention of the driver is directly reflected to thereby regulate a change quantity of the ultimate target phase angle on the basis of the torque demand of high accuracy.

By virtue of the arrangement of the valve timing control apparatus described above, it is possible to regulate or adjust the change quantity of the valve timing with high degree of freedom. Thus, occurrence of shock unexpected by the driver can positively be avoided, while the lock pin can be released from the locked state without fail. As a result, performance of the engine in respect to the output torque, the exhaust gas quality and others can be improved very significantly.

Moreover, in the valve timing control apparatus described above, the valve timing control apparatus may further include the intake air flow parameter detecting means for detecting an intake air flow parameter which corresponds to an intake air flow in the internal combustion engine. In that case, the limiting means mentioned above can be so designed as to estimate the torque demand on the basis of the intake air flow parameter which functions directly as one of the important factors in the generation of torque.

With the arrangement described above, it is possible to regulate or adjust the change quantity of the valve timing with high degree of freedom. Thus, occurrence of shock unexpected by the driver can positively be avoided, while the lock pin can be released from the locked state without fail. Consequently, performance of the engine in respect to the output torque, the exhaust gas quality and others can be improved very significantly.

Many modifications and variations of the present invention are possible in the light of the above techniques. It is therefore to be understood that within the scope of the appended claims, the invention maybe practiced otherwise than as specifically described.

What is claimed is:

1. A valve timing control apparatus for an internal combustion engine, comprising:

a cam shaft rotatable in synchronism with rotation of a crank shaft of said internal combustion engine for thereby setting valve timing for at least one of an intake valve and an exhaust valve of said engine;

a cam phase actuator having a valve timing advancing hydraulic chamber and a valve timing retarding hydraulic chamber to which hydraulic pressure is fed for changing a relative angle of said cam shaft to said crank shaft in a valve timing advancing direction or alternatively in a valve timing retarding direction;

a locking mechanism provided in association with said cam phase actuator for locking said relative angle at a predetermined relative angle;

an oil pump for generating said hydraulic pressure;

hydraulic pressure regulating means for feeding said hydraulic pressure to said valve timing advancing hydraulic chamber or alternatively to said valve timing retarding hydraulic chamber; and an engine control unit for controlling said hydraulic pressure regulating means;

said locking mechanism being released under the effect of the hydraulic pressure fed to either one of said valve timing advancing hydraulic chamber or said valve timing retarding hydraulic chamber of said cam phase actuator upon changing of said relative angle, wherein when said relative angle is to be changed from the locked state validated by said locking mechanism, a transition into a phase feedback control of said relative angle is performed and a target phase angle of said cam shaft is limited, as soon as a control for releasing said locked state is executed;

wherein said engine control unit includes change quantity limiting means for limiting a change quantity of said valve timing, said change quantity limiting means being designed for limiting said change quantity of said valve timing to a predetermined value upon said transition of said locked state releasing control into said phase feedback control.

2. A valve timing control apparatus for an internal combustion engine according to claim 1, wherein said change quantity limiting means is designed for limiting a change quantity of a said target phase angle of said cam shaft relative to said crank shaft.

3. A valve timing control apparatus for an internal combustion engine according to claim 2, wherein said change quantity limiting means is so designed as to estimate a torque demand existing at a time point when the control for releasing said locked state is started, to thereby modify a degree of limitation for the change quantity of said target phase angle.

4. A valve timing control apparatus for an internal combustion engine according to claim 3, wherein said change quantity limiting means is so designed as to estimate said torque demand on the basis of said target phase angle.-

5. A valve timing control apparatus for an internal combustion engine according to claim 3, further comprising throttle opening degree detecting means for detecting a throttle opening degree of said internal combustion engine, wherein said limiting means is so designed as to estimate said torque demand on the basis of said throttle opening degree.

6. A valve timing control apparatus for an internal combustion engine according to claim 3, further comprising intake air flow parameter detecting means for detecting an intake air flow parameter which corresponds to an intake air flow in said internal combustion engine, wherein said limiting means is so designed as to estimate said torque demand on the basis of said intake air flow parameter.

* * * * *